US008508556B2

(12) United States Patent
Hsu et al.

(10) Patent No.: US 8,508,556 B2
(45) Date of Patent: Aug. 13, 2013

(54) IMAGE DISPLAY METHOD

(75) Inventors: Ching-Fu Hsu, Taichung County (TW); Chih-Chang Lai, Taichung County (TW); Shiao-Hui Liao, Taichung (TW); Ting-Yu Chang, Kaohsiung County (TW)

(73) Assignee: Wintek Corporation, Taichung (TW)

( * ) Notice: Subject to any disclaimer, the term of this patent is extended or adjusted under 35 U.S.C. 154(b) by 647 days.

(21) Appl. No.: 12/763,221

(22) Filed: Apr. 20, 2010

(65) Prior Publication Data

US 2010/0265263 A1 Oct. 21, 2010

(30) Foreign Application Priority Data

Apr. 20, 2009 (TW) ..... 98113018 A

(51) Int. Cl.
*G09G 5/10* (2006.01)

(52) U.S. Cl.
USPC ..... 345/690; 345/589; 345/590; 345/596; 345/597; 345/207; 345/214; 382/167; 382/168; 382/169; 382/274

(58) Field of Classification Search
None
See application file for complete search history.

(56) References Cited

U.S. PATENT DOCUMENTS

| | | | | |
|---|---|---|---|---|
| 5,831,693 | A | 11/1998 | McCartney, Jr. et al. | |
| 6,592,232 | B2 | 7/2003 | McGowan | |
| 6,798,395 | B1 | 9/2004 | Yamauchi et al. | |
| 6,944,336 | B2 * | 9/2005 | Chiu | 382/167 |
| 7,053,881 | B2 | 5/2006 | Itoh | |
| 7,161,569 | B2 | 1/2007 | Sekiguchi | |
| 7,259,769 | B2 | 8/2007 | Diefenbaugh et al. | |
| 7,873,229 | B2 * | 1/2011 | Sankar et al. | 382/254 |
| 8,223,113 | B2 * | 7/2012 | Kerofsky | 345/102 |
| 8,237,688 | B2 * | 8/2012 | Huang et al. | 345/204 |
| 2008/0094025 | A1 | 4/2008 | Rosenblatt et al. | |

FOREIGN PATENT DOCUMENTS

| | | |
|---|---|---|
| TW | M306336 | 2/2007 |

* cited by examiner

*Primary Examiner* — Antonio A Caschera
(74) *Attorney, Agent, or Firm* — Jianq Chyun IP Office

(57) ABSTRACT

An image display method including following steps is provided. A backlight of a display panel is adaptively adjusted according to a backlight adjustment factor related to the intensity value of an external light and the brightness of an original image. Brightness factors of the original image are corrected according to the adjustment of the backlight, and the original image is reset by using the corrected brightness factors and original color factors. Thereby, the problem of image distortion caused by backlight adjustment can be reduced.

25 Claims, 19 Drawing Sheets

IMAGE DISPLAY METHOD

CROSS-REFERENCE TO RELATED APPLICATION

This application claims the priority benefit of Taiwan application serial no. 98113018, filed on Apr. 20, 2009. The entirety of the above-mentioned patent application is hereby incorporated by reference herein and made a part of specification.

BACKGROUND OF THE INVENTION

1. Field of the Invention

The present invention generally relates to an image display method, and more particularly, to an image display method which can reset an original image according to the adjustment of a backlight.

2. Description of Related Art

A LCD includes a LCD panel and a light source module. The LCD panel itself does not emit light, and therefore the light source module has to be disposed for providing a surface light source to allow the LCD panel to display images. The light source module needs to emit light constantly once the LCD is turned on, and accordingly the light source module is the most power-consuming component in the LCD. Generally speaking, the power consumed by a light source module is about 70% of the power consumed by an entire LCD.

In order to resolve foregoing problem, in U.S. Pat. No. 7,053,881, the peak value of different image data is calculated, and the backlight is adjusted according to the calculated peak value, so that the affection of brightness variations to the image contrast can be reduced. However, this technique reduces the display quality and cannot keep the visual effect of an original image. Besides, in U.S. Pat. No. 7,259,769, the external light is detected by using a photo sensor device, and the image is adjusted through image processing according to a look-up table of gamma. However, this technique requires different designs regarding different devices and takes up too much memory space, and as a result, causes both hardware cost and software cost to be increased.

SUMMARY OF THE INVENTION

Accordingly, the present invention is directed to an image display method, wherein a backlight of a display panel is adjusted according to an external light, brightness factors of an original image are corrected according to the adjustment of the backlight, and the original image is reset by using the corrected brightness factors and original color factors. Accordingly, the problem of image contrast distortion caused by backlight adjustment can be resolved without affecting the image visual effect or increasing the hardware/software cost.

The present invention provides an image display method including following steps. An image brightness value is generated by analyzing the brightness distribution of an original image, and an external brightness value is generated according to the intensity value of an external light around a display panel. Then, a backlight adjustment factor is set according to the external brightness value, the image brightness value, and a maximum brightness value. On the other hand, the image brightness value is analyzed to set a reference turning point in a brightness conversion coordinate according to an analysis result, wherein the reference turning point is related to the backlight adjustment factor and the maximum brightness value.

Next, a plurality of relative turning points is set in the brightness conversion coordinate according to the analysis result, the reference turning point, and a plurality of predetermined slopes, and the reference turning point and the relative turning points are sequentially connected with the origin of the brightness conversion coordinate as a starting point, so as to form a brightness conversion curve. After that, a plurality of brightness factors corresponding to a plurality of original gray scale values in the original image are corrected according to the brightness conversion curve, and a plurality of corresponding corrected gray scale values are generated according to the corrected brightness factors. Next, the original image is reset by using the corrected gray scale values, and a backlight for displaying the original image is adjusted by using the backlight adjustment factor.

According to an embodiment of the present invention, the image display method further includes: converting the external light into an electric signal by using a solar cell, and generating the intensity value of the external light according to the electric signal; and charging a battery by using the electric signal, and determining whether the power of the display panel is supplied by the battery or the solar cell according to the electric signal.

As described above, in the present invention, a backlight of a display panel is adaptively adjusted according to a backlight adjustment factor related to the intensity value of an external light and the brightness of an original image, so as to reduce the power consumption of the display panel effectively. Moreover, in the present invention, brightness factors in the original image are corrected according to the adjustment of the backlight, and the original image is reset according to the corrected brightness factors, so that the problem of image contrast distortion caused by backlight adjustment can be effectively resolved without affecting the image visual effect or increasing the software/hardware cost. Furthermore, in the present invention, a solar cell is adopted and the power required by a display panel is supplied by an external light source, so that the display panel is made more environment-friendly.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
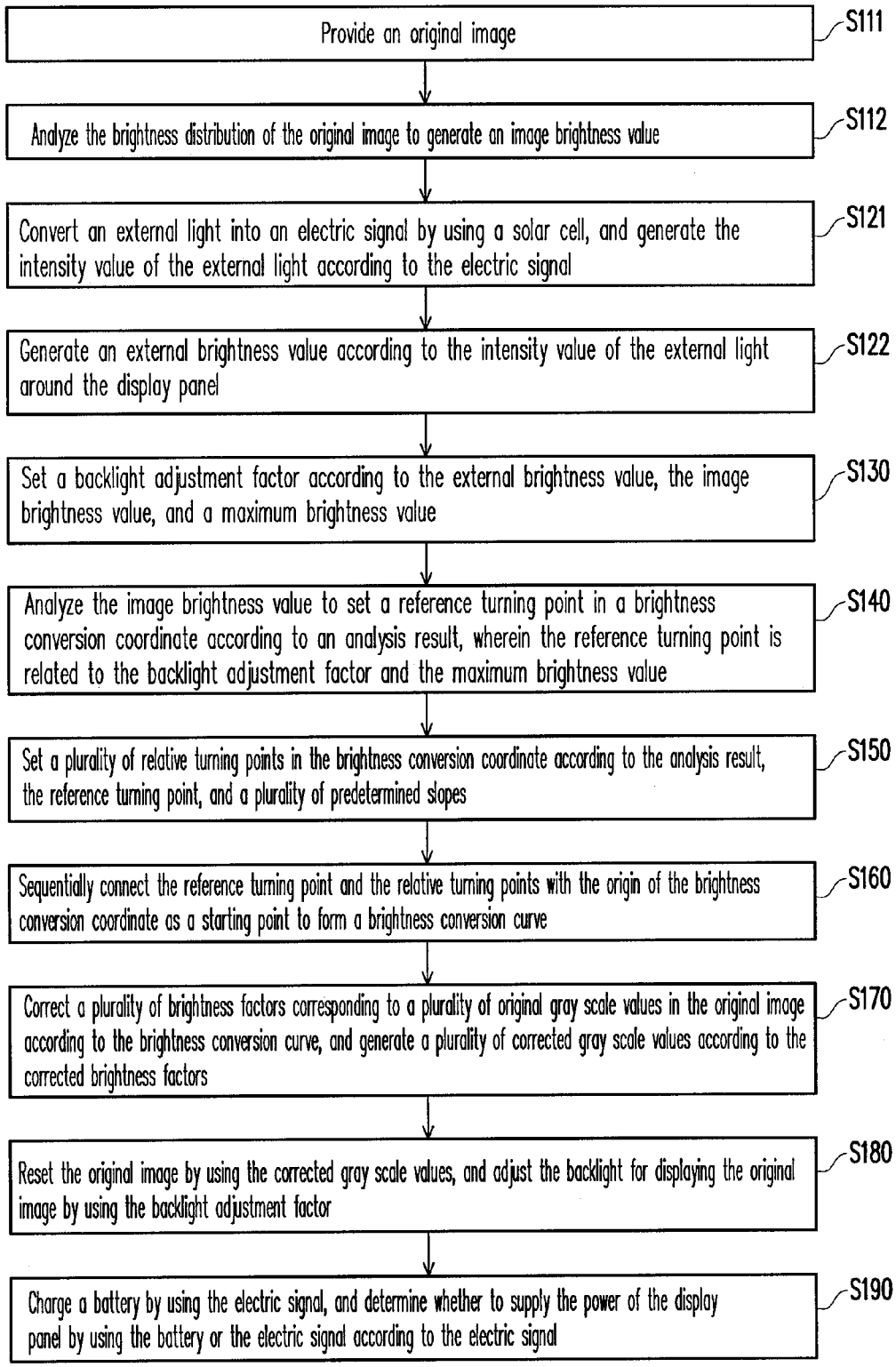
FIG. 1 is a flowchart of an image display method according to a first embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

First Embodiment

FIG. 1 is a flowchart of the first embodiment of the present invention, and which is adaptable to a transmissive display panel. In step S111, an original image is provided. Then, in step S112, the brightness distribution of the original image is analyzed to generate an image brightness value.

Figure 2:
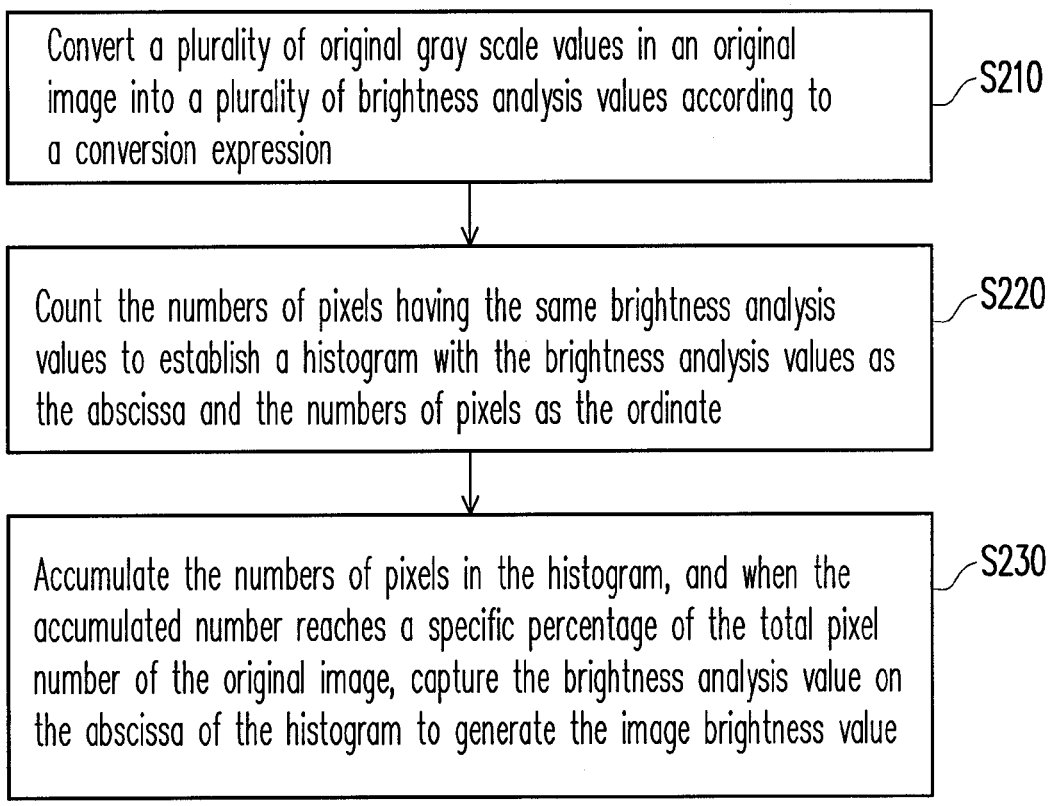
FIG. 2 is a detailed flowchart of step S112.

Referring to FIG. 2, in step S210, a plurality of original gray scale values in the original image is converted into a plurality of brightness analysis values according to a conversion expression. For example, if an $i^{th}$ brightness analysis value is denoted as $BT_i$, the three sub gray scale values in the $i^{th}$ original gray scale value are respectively denoted as $r_i$, $g_i$, and $b_i$, a maximum brightness value is denoted as $apl_{max}$, a maximum gray scale value is denoted as $gr_{max}$, and i is an integer greater than 0, each of the original gray scale values can be converted into the corresponding brightness analysis value through the following conversion expression (1):

$$BT_i = (0.299 \times r_i + 0.578 \times g_i + 0.114 \times b_i) \times \frac{apl_{max}}{gr_{max}} \quad \text{Expression (1)}$$

Figure 3:
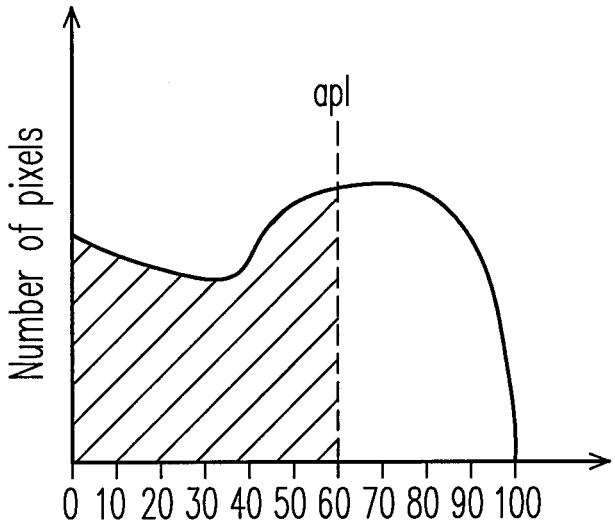
FIG. 3 is a histogram of step S220.

Additionally, to analyze the brightness distribution of the original image, in step S220, a the abscissa of the histogram is established. As shown in FIG. 3, for example, the abscissa of the histogram includes the brightness analysis values from 1 to 100, and the numbers of pixels corresponding to different brightness analysis values are reflected by the curve in FIG. 3. Next, in step S230, the numbers of pixels in the histogram are accumulated, and when the accumulated number reaches a specific percentage of the total pixel number of the original image, the brightness analysis value on the abscissa of the histogram is captured to generate the image brightness value.

For example, if the specific percentage in the present embodiment is assumed to be 50% and the total pixel number of the original image is assumed to be 100, referring to FIG. 3, in step S230, the number of pixels with the brightness analysis value equal to 1 is added to the number of pixels with the brightness analysis value equal to 2, the obtained sum is then added to the number of pixels with the brightness analysis value equal to 3, and so on. If the accumulated number of pixels is equal to 100×50%, while the number of pixels with the brightness analysis value equal to 60 reached, the brightness analysis value (60) is captured and used for determining the image brightness value apl of the original image. However, the values of the specific percentage and the total pixel number specified in the present embodiment are not intended to limiting the present embodiment; instead, these values can be determined according to the actual requirement.

Referring to FIG. 1 again, besides analyzing the brightness distribution of the original image, in the present embodiment, the intensity value of the external light is further detected to use the external light as an assistant light source of the display panel appropriately. In step S121, the external light is converted into an electric signal by using a solar cell, and the intensity value of the external light is generated according to the electric signal. Accordingly, the intensity value of the external light irradiating around the display panel can be obtained. After that, in step S122, an external brightness value is generated according to the intensity value of the external light around the display panel, and in step S130, a backlight adjustment factor is set according to the external brightness value, the image brightness value and the maximum brightness value.

It should be noted that the image display method in the present embodiment is adaptable to a transmissive display panel. Thus, the display brightness of the display panel has to be increased in a brighter environment to brighten up the displayed images while decreased in a darker environment to provide a comfortable feel to the users. Thus, foregoing steps S122 and S130 will be further described.

Figure 4:
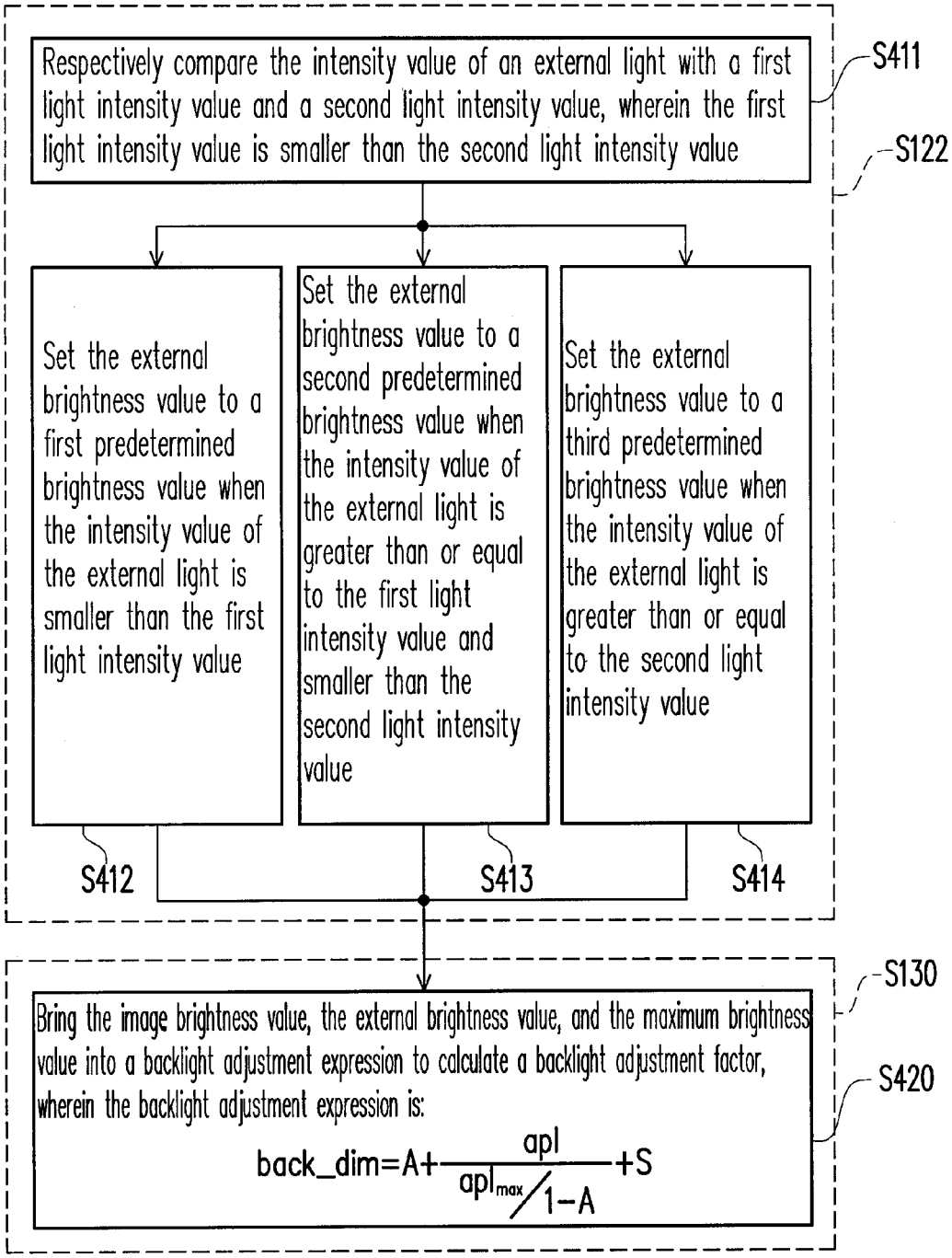
FIG. 4 is a detailed flowchart of steps S122 and S130.

FIG. 4 is a detailed flowchart of the steps S122 and S130. Referring to FIG. 4, to generate the external brightness value, first, in step S411, the intensity value of the external light detected by the solar cell is respectively compared with a first light intensity value and a second light intensity value, wherein the first light intensity value is smaller than the second light intensity value. For example, the first light intensity value may be 1000 lux, and the second light intensity value may be 5000 lux.

Thereafter, in steps S412~S414, to be specific, the external brightness value is set to the first predetermined brightness value $b_0$ when the intensity value of the external light is smaller than the first light intensity value, the external brightness value is set to the second predetermined brightness value $b_1$ when the intensity value of the external light is greater than or equal to the first light intensity value and smaller than the second light intensity value, and the external brightness value is set to the third predetermined brightness value $b_2$ when the intensity value of the external light is greater than or equal to the second light intensity value.

Herein the first predetermined brightness value to the third predetermined brightness value $b_0$~$b_2$ may be respectively 0.05, 0.15, and 0.3, and the conditions for setting the external brightness value S may be listed as:

$$S=b_0=0.05 \text{ when } L<V_{IN1};$$

$$S=b_1=0.15 \text{ when } V_{IN1} \leqq L<V_{IN2};$$

$$S=b_2=0.3 \text{ when } V_{IN2} \leqq L;$$

wherein L represents the intensity value of the external light, $V_{IN1}$ represents the first light intensity value, and $V_{IN2}$ represents the second light intensity value.

It should be mentioned that besides setting the external brightness value according to the $V_{IN1}$ and $V_{IN2}$, the external brightness value may also be set according to a backlight transmissible ratio. In another embodiment of the present invention, the first light intensity value $V_{IN1}$ and the second light intensity value $V_{IN2}$ can be adjusted by using a backlight transmissible ratio BTR. Accordingly, the conditions for setting the external brightness value S can be listed as:

$$S=b_0=0.05 \text{ when } L<V_{IN1}\times\text{BTR};$$

$$S=b_1=0.15 \text{ when } V_{IN1}\times\text{BTR}\leqq L<V_{IN2}\times\text{BTR};$$

$$S=b_2=0.3 \text{ when } V_{IN2}\times\text{BTR}\leqq L;$$

After obtaining the image brightness value apl and the external brightness value S respectively through the step S112 and the steps S411~S414, in step S420, the image brightness value apl, the external brightness value S, and the maximum brightness value $apl_{max}$ are adapted to a backlight adjustment expression to calculate a backlight adjustment factor back_dim, wherein the backlight adjustment expression is:

$$\text{back_dim} = A + \frac{apl}{apl_{max}/1-A} + S \qquad \text{Expression (2)}$$

wherein A is a constant value which falls within a range of 0 to 1. For example, the value of A may be a ratio between a minimum transmissible brightness and a maximum transmissible brightness of a backlight source of the display panel. Accordingly, A is set to 0.5 when the minimum transmissible brightness of the backlight source of a specific display panel is 0.5 times of the maximum transmissible brightness thereof.

It should be noted that the maximum value of the backlight adjustment factor back_dim is 1, so that the when the backlight adjustment factor back_dim calculated through foregoing expression (2) is greater than 1, the backlight adjustment factor back_dim is set to 1. Besides, in another embodiment of the present invention, the backlight adjustment factor back_dim may be sent back to the conditional expressions for setting the external brightness value S. Namely, the backlight transmissible ratio BTR is generated according to the backlight adjustment factor back_dim, so as to instantly adjust the conditional expressions for setting the external brightness value according to variations of the backlight of the display panel.

Referring to FIG. 1 again, after the backlight adjustment factor is obtained, a brightness conversion curve in a brightness conversion coordinate is obtained through steps S140~S160. In step S140, the image brightness value is analyzed to set a reference turning point in the brightness conversion coordinate according to an analysis result, wherein the reference turning point is related to the backlight adjustment factor and the maximum brightness value. Then, in step S150, a plurality of relative turning points in the brightness conversion coordinate is set according to the analysis result, the reference turning point, and a plurality of predetermined slopes. In step S160, the reference turning point and the relative turning points are sequentially connected with the origin of the brightness conversion coordinate as a starting point, so as to form the brightness conversion curve.

Figure 5:
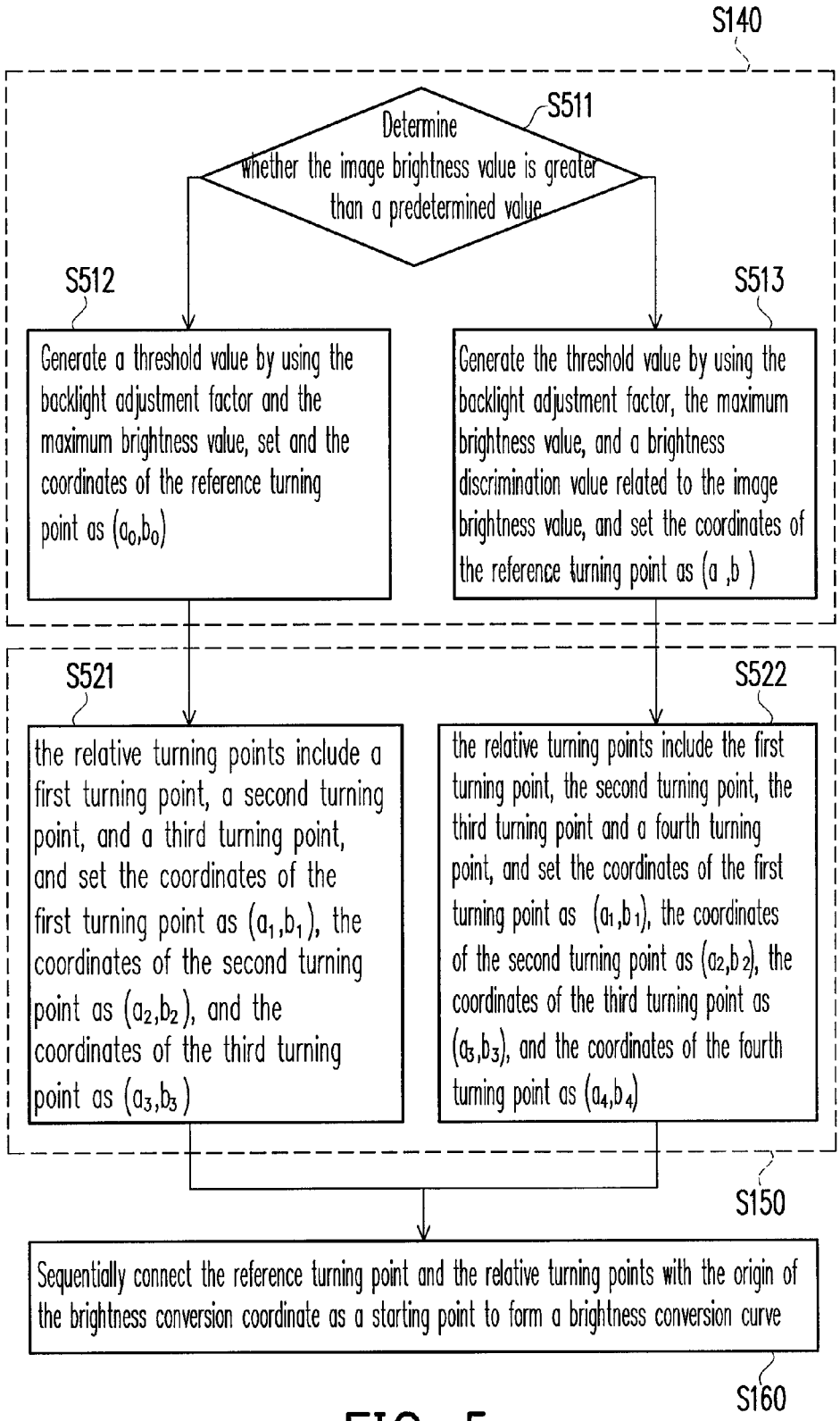
FIG. 5 is a detailed flowchart of steps S140~S160.

FIG. 5 is a detailed flowchart of foregoing steps S140~S160. Referring to FIG. 5, In step S511, whether the image brightness value is greater than a predetermined value is determined, wherein the predetermined value may be 12. When the image brightness value is greater than the predetermined value, in step S512, a threshold value is generated by using the backlight adjustment factor back_dim and the maximum brightness value $apl_{max}$, and the coordinates of the reference turning point is set as $(a_0,b_0)$. It should be noted that the threshold is as shown in following expression (3), and the coordinates $a_0$ and $b_0$ are shown in following expressions (4) and (5) respectively:

$$\text{threshold}=\text{back_dim}\times apl_{max} \qquad \text{Expression (3)}$$

$$a_0=\text{threshold}\times\text{back_dim} \qquad \text{Expression (4)}$$

$$b_0=\text{threshold} \qquad \text{Expression (5)}$$

In addition, when the image brightness value is smaller than the predetermined value, in step S513, the threshold value is generated by using the backlight adjustment factor back_dim, the maximum brightness value $apl_{max}$, and a brightness discrimination value a related to the image brightness value, and the coordinates of the reference turning point is set as $(a_0,b_0)$. In the present embodiment, the brightness discrimination value a may be 12-$apl_{max}$. It should be noted that the threshold is as shown in following expression (6), and the coordinates $a_0$ and $b_0$ are respectively as shown in following expressions (7) and (8).

$$\text{threshold}=\text{back_dim}\times apl_{max}+a \qquad \text{Expression (6)}$$

$$a_0=\text{threshold}\times\text{back_dim} \qquad \text{Expression (7)}$$

$$b_0=\text{threshold} \qquad \text{Expression (8)}$$

The threshold can be calculated by selectively using the expression (3) or (6) along with the variation of the image brightness value, and after the threshold is determined, the coordinates $(a_0,b_0)$ of the reference turning point can be set according to the threshold and the backlight adjustment factor back_dim.

On the other hand, the detailed procedure for setting the relative turning points are as illustrated in steps S521 and S522. Herein, it is assumed that the predetermined slopes mentioned in step S150 include a first predetermined value A, a second predetermined value B, a third predetermined value C, and a fourth predetermined value D, and the settings of the relative turning points according to the analysis result will be described below. Herein the first predetermined value A is 0.28, the second predetermined value B is 0.31, the third predetermined value C is 0.3, and the fourth predetermined value D is 1.3.

When the analysis result indicates that the image brightness value is greater than the predetermined value, step S521 is executed, wherein the relative turning points mentioned in step S150 include a first turning point, a second turning point, and a third turning point. In addition, the coordinates of the first turning point are further set as $(a_1,b_1)$, the coordinates of the second turning point are set as $(a_2,b_2)$, and the coordinates of the third turning point are set as $(a_3,b_3)$, wherein the coordinates of the turning points are respectively as below:

$$a_1,b_1=apl_{max};a_2=((apl_{max}-a_0)\times B)+a_3,b_2=(apl_{max}-(C\times(apl_{max}-a_2)));$$

$$a_3=((apl_{max}-a_0)\times A)+a_0,b_3=(b_2-(D\times(a_2-a_3))).$$

Figure 6:
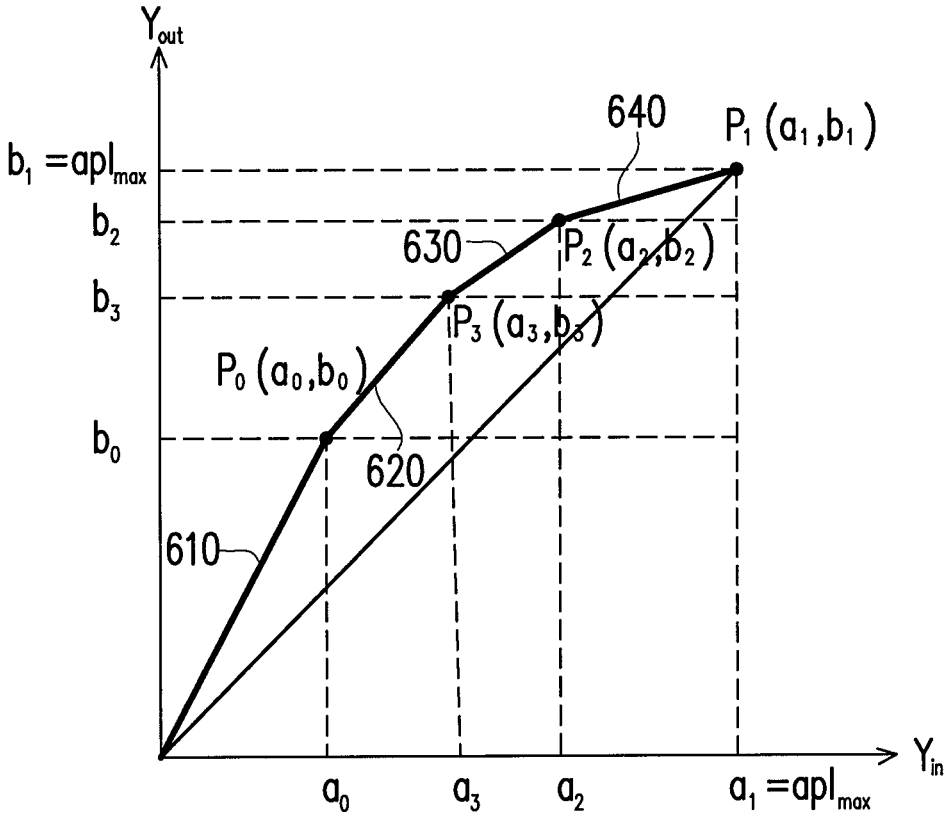
FIG. 6 is a diagram of a brightness conversion coordinate produced when an image brightness value is greater than a predetermined value.

FIG. 6 is a diagram of a brightness conversion coordinate produced when the image brightness value is greater than the predetermined value, wherein Yin indicates the brightness factors, and Yout indicates the corrected brightness factors. As shown in FIG. 6, when the image brightness value is greater than the predetermined value, the coordinates $(a_0,b_0)$ of the reference turning point $P_0$ are set in step S512, and then in step S521, the first turning point $P_1$, the second turning point $P_2$, and the third turning point $P_3$ are extended and the coordinates thereof are set. After the reference turning point $P_0$ and the turning points $P_1$~$P_3$ are all set, in step S160, the reference turning point $P_0$ and the turning points $P_1$~$P_3$ are sequentially connected with the origin of the brightness conversion coordinate as a starting point to form the brightness conversion curve composed of line segments 610~640.

When the analysis result indicates that the image brightness value is smaller than the predetermined value, step S522 is executed. The coordinates of the first, second, third and fourth turning points are set as $(a_1,b_1)$, $(a_2,b_2)$, $(a_3,b_3)$, and $(a_4,b_4)$ respectively, wherein the coordinates of the turning points are respectively:

$$a_1,b_1=apl_{max};a_2=((apl_{max}-a_0)\times B)+a_3,b_2=(apl_{max}-(C\times(apl_{max}-a_2)));$$

$$a_3=((apl_{max}-a_0)\times A)+a_0,b_3=(b_2-(D\times(a_2-a_3)));a_4=a,b_4=0.$$

Figure 7:
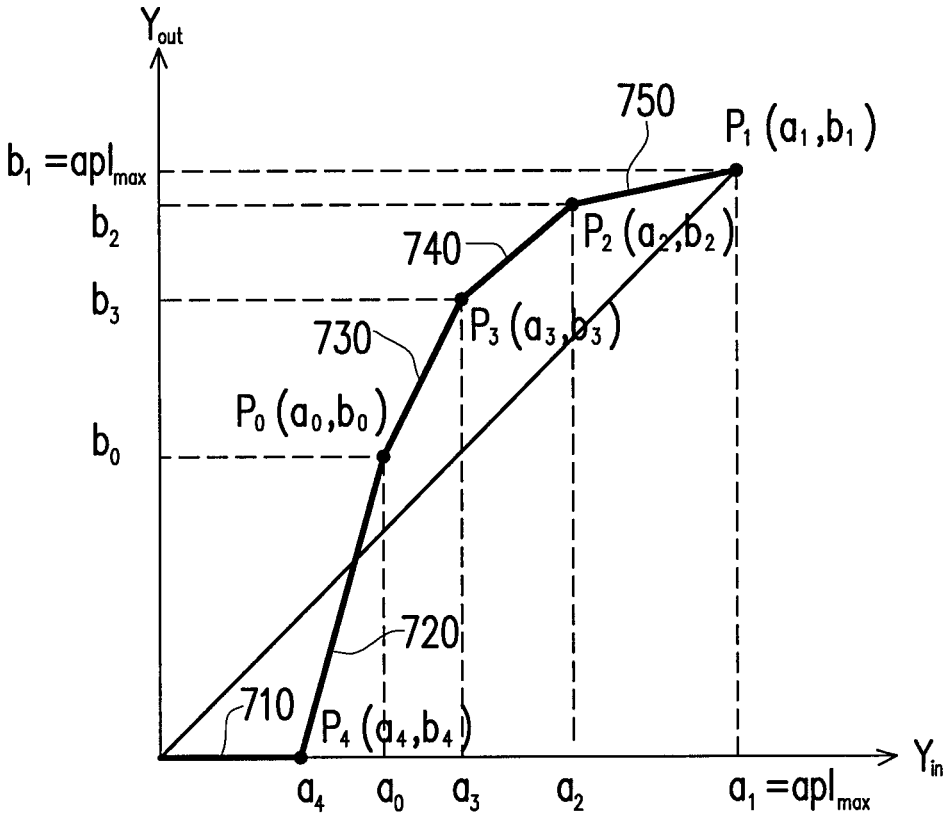
FIG. 7 is a diagram of a brightness conversion coordinate produced when an image brightness value is smaller than a predetermined value.

FIG. 7 is a diagram of a brightness conversion coordinate produced when the image brightness value is smaller than the predetermined value. As shown in FIG. 7, in step S513, the coordinates $(a_0,b_0)$ of the reference turning point $P_0$ are set, and then in step S522, the $P_1$, $P_2$, $P_3$, and $P_4$ are extended, and the coordinates of the turning points $P_1$~$P_4$ are respectively set. After the reference turning point $P_0$ and the turning points $P_1$~$P_4$ are all set, in step S160, the reference turning point $P_0$ and the turning points $P_1$~$P_4$ are sequentially connected with the origin of the brightness conversion coordinate as a starting point, so as to form the brightness conversion curve composed of the line segments 710~750.

Referring to FIG. 1 again, after the brightness conversion curve is obtained, in step S170, a plurality of brightness factors corresponding to a plurality of original gray scale values in the original image are corrected according to the brightness conversion curve, and a plurality of corrected gray scale values are generated according to the corrected brightness factors.

Figure 8:
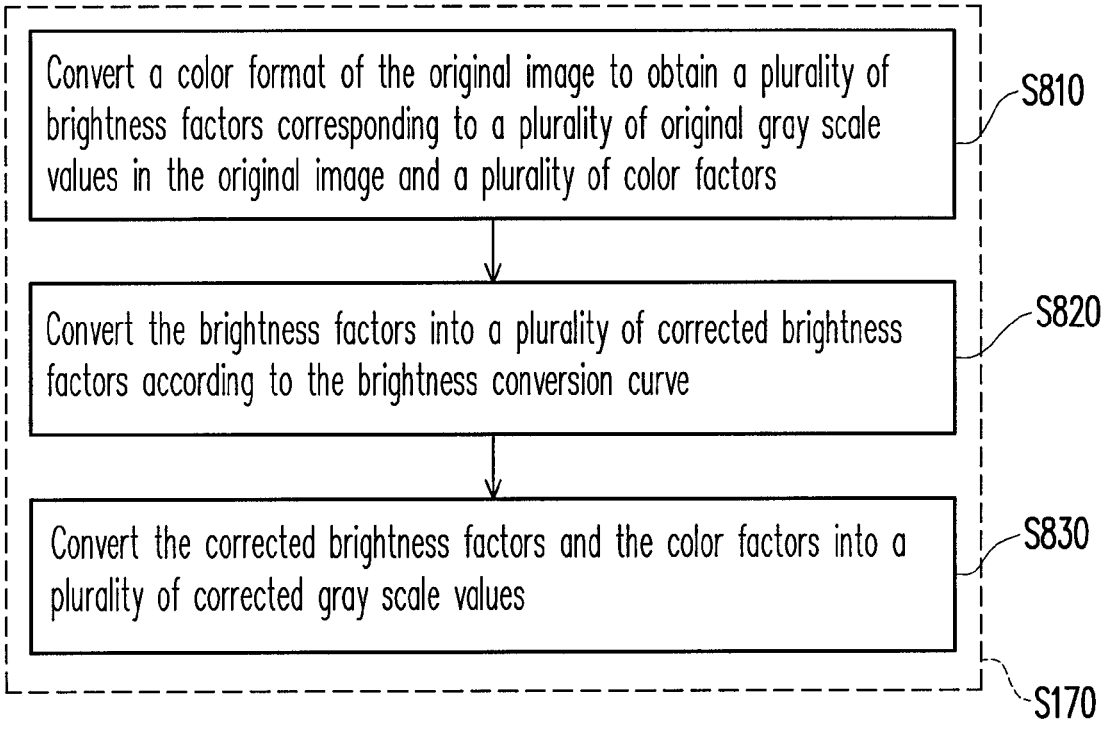
FIG. 8 is a detailed flowchart of step S170.

FIG. 8 is a detailed flowchart of foregoing step S170. Referring to FIG. 8, in step S810, a color format of the original image is converted to obtain a plurality of brightness factors corresponding to a plurality of original gray scale values in the original image and a plurality of color factors. Then, in step S820, the brightness factors are converted into a plurality of corrected brightness factors according to the brightness conversion curve. In step S830, the corrected brightness factors and the original color factors are converted into a plurality of corrected gray scale values.

Accordingly, the backlight for displaying the original image can be adjusted according to the backlight adjustment factor during the step 180 in FIG. 1. For example, in the present embodiment, a pulse width modulation (PWM) signal is generated based on the backlight adjustment factor to control the backlight. Besides, in step S180, the original image is reset by these corrected gray scale values. In other words, in the image display method provided by the present embodiment, the backlight can be adaptively adjusted according to the intensity value of external light so that the power consumption of the display panel can be effectively reduced without increasing the software/hardware cost.

Referring to FIG. 1 again, the image display method in the present embodiment further comprises a step S190. In step S190, a battery is charged by using an electric signal converted by a solar cell wherein the power of the display panel can be supplied by the battery or the electric signal depending on the electric signal.

Figure 9:
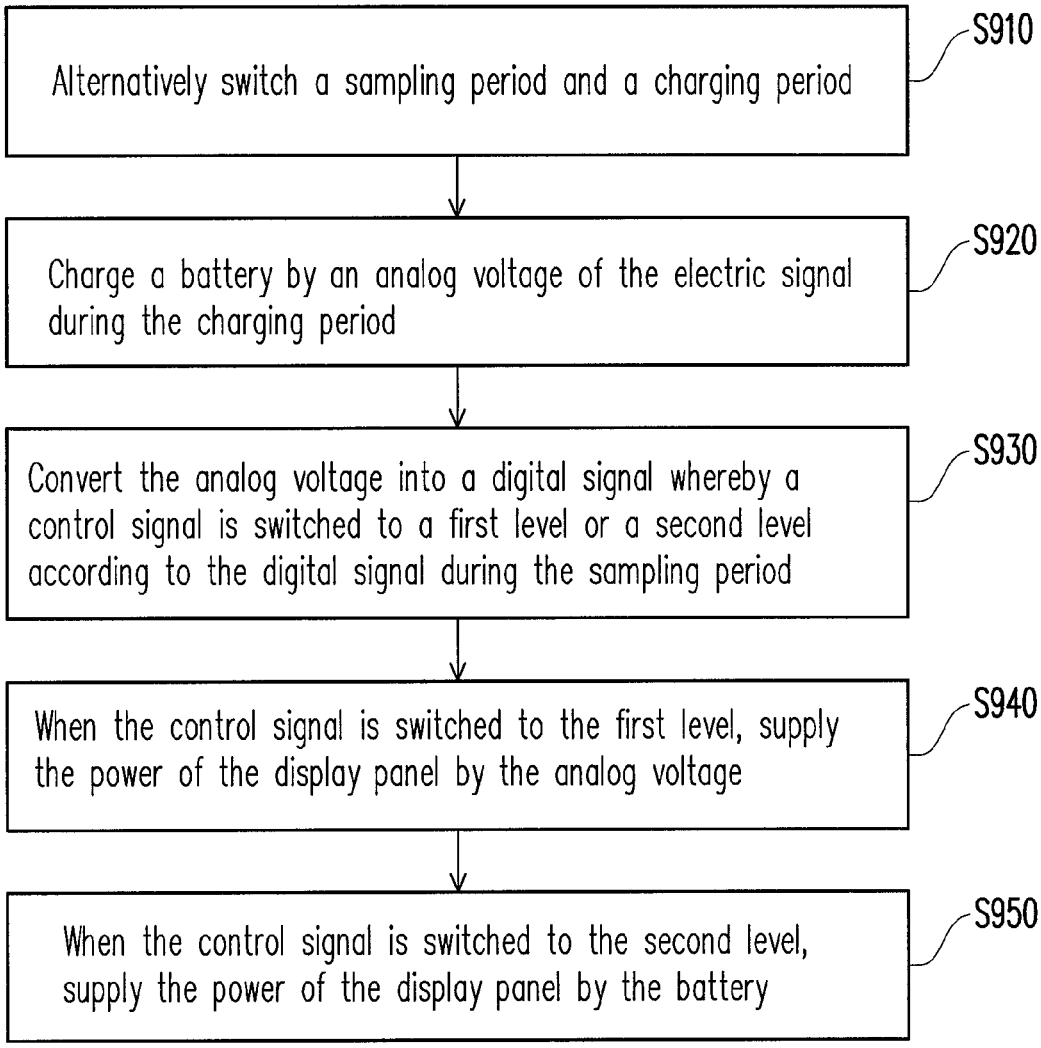
FIG. 9 is a detailed flowchart of step S190 according to an embodiment of the present invention.
Figure 10:
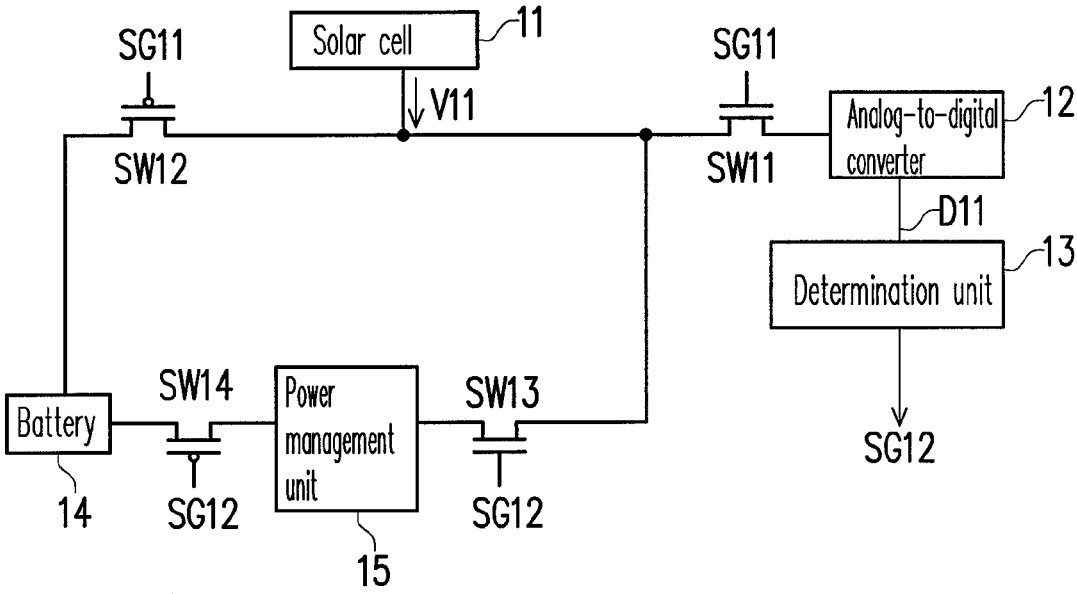
FIG. 10 is a circuit block diagram of the embodiment in FIG. 9.

Referring to FIG. 9 and FIG. 10 wherein FIG. 9 is a detailed flowchart illustrating the step S190 of the present embodiment, and FIG. 10 is a circuit block diagram of the embodiment in FIG. 9. The circuit includes a solar cell 11, a plurality of switches SW11~SW14, an analog-to-digital converter 12, a determination unit 13, a battery 14, and a power management unit 15.

In step S910, a sampling period and a charging period are alternatively switched. Then, the battery is charged by an analog voltage of the electric signal in step S920, and in step S930, the analog voltage is converted into a digital signal whereby a control signal is switched to a first level or a second level according to the digital signal during the sampling period. Accordingly, when the control signal is switched to the first level, the power of the display panel is supplied by the analog voltage (step S940). Contrarily, when the control signal is switched to the second level, the power of the display panel is supplied by the battery (step S950).

For example, as shown in FIG. 10, the solar cell 11 converts the external light into the electric signal, wherein the electric signal is in direct ratio to the intensity value of the external light thereby determining the intensity value of the external light according to the electric signal. Besides, the electric signal generated by the solar cell 11 contains an analog voltage and an analog current, and the circuit illustrated in FIG. 10 is functioned according to the analog voltage V11 generated by the solar cell 11.

Herein the switch SW11 and the switch SW12 are respectively composed of an N-type transistor and a P-type transistor, and both controlled by the same control signal SG11 such that the switch SW12 is turned off when the switch SW11 is turned on. In this case, the analog voltage V11 generated by the solar cell 11 is sent to the analog-to-digital converter 12 to convert the analog voltage V11 into a digital signal D11 transferred to the determination unit 13.

The determination unit 13 provides the control signal SG12 at a first level (for example, logic 1) or a second level (for example, logic 0) according to the digital signal D11. For example, when the analog voltage V11 is between 2.8V and 3.3V, the determination unit 13 switches the control signal SG12 to the first level (for example, logic 1). Contrarily, if V11 is not between 2.8V and 3.3V, the determination unit 13 switches the control signal SG12 to the second level (for example, logic 0).

When the switch SW11 is turned off and the switch SW12 is turned on, the battery 14 is charged by the analog voltage V11 generated by the solar cell 11. In other words, the sampling period and the charging period are defined through the switching of the switch SW11 and the switch SW12. During the sampling period, the analog voltage V11 is converted into the digital signal D11 by the analog-to-digital converter 12 so that the determination unit 13 can generate the control signal SG12. During the charging period, the analog voltage V11 is utilized to charge the battery 14.

On the other hand, the control signal SG12 generated by the determination unit 13 is used for controlling the switch SW13 and the switch SW14 respectively composed of an N-type transistor and a P-type transistor. Accordingly, when the control signal SG12 is switched to the first level (for example, logic 1), the switch SW13 is turned on, and the switch SW14 is turned off. In this case, the analog voltage V11 generated by the solar cell 11 is sent to the power management unit 15 to supply the power of the display panel. Contrarily, when the control signal SG12 is switched to the second level (for example, logic 0), the switch SW13 is turned off, and the switch SW14 is turned on. In this case, the voltage generated by the battery 14 is sent to the power management unit 15 to supply the power of the display panel.

Figure 11:
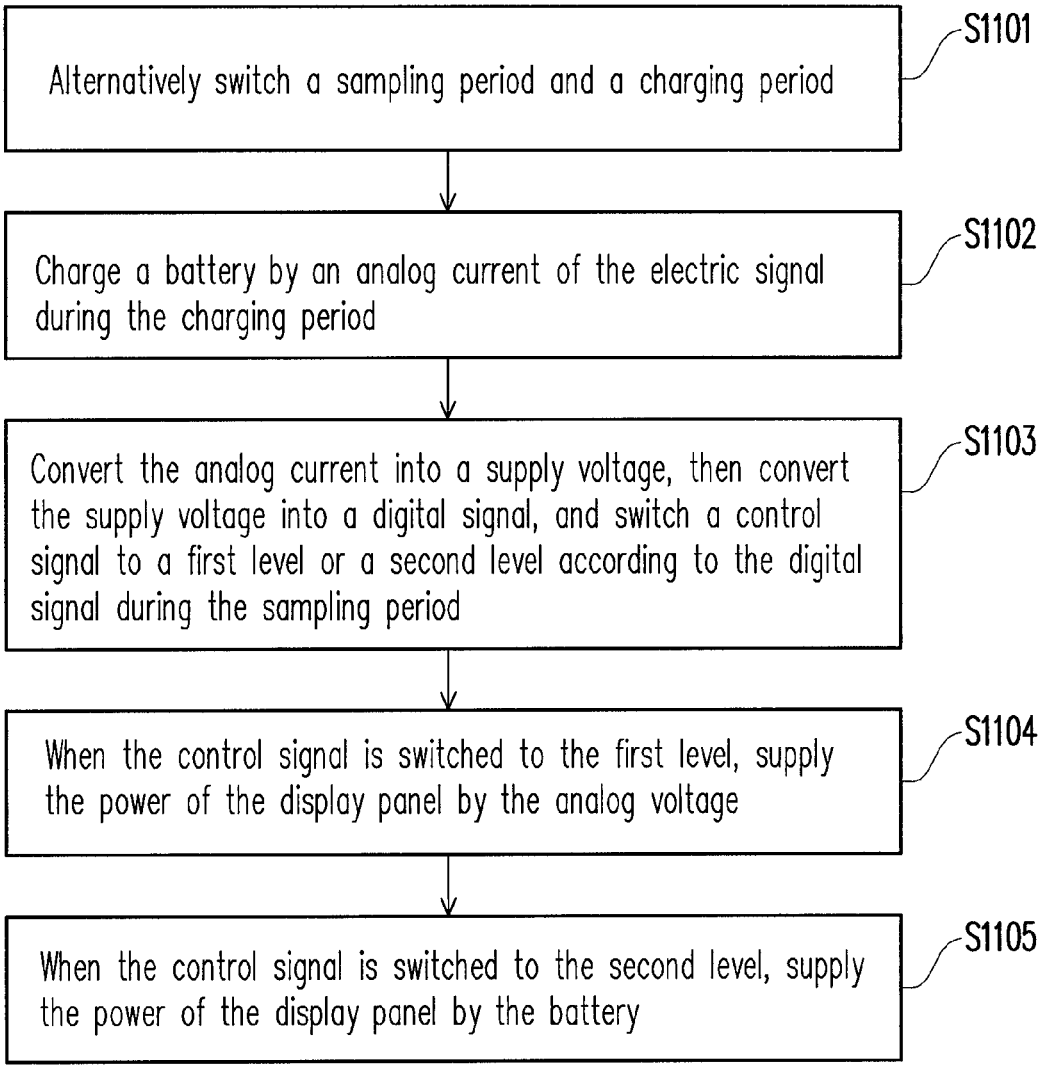
FIG. 11 is a detailed flowchart of step S190 according to another embodiment of the present invention.
Figure 12:
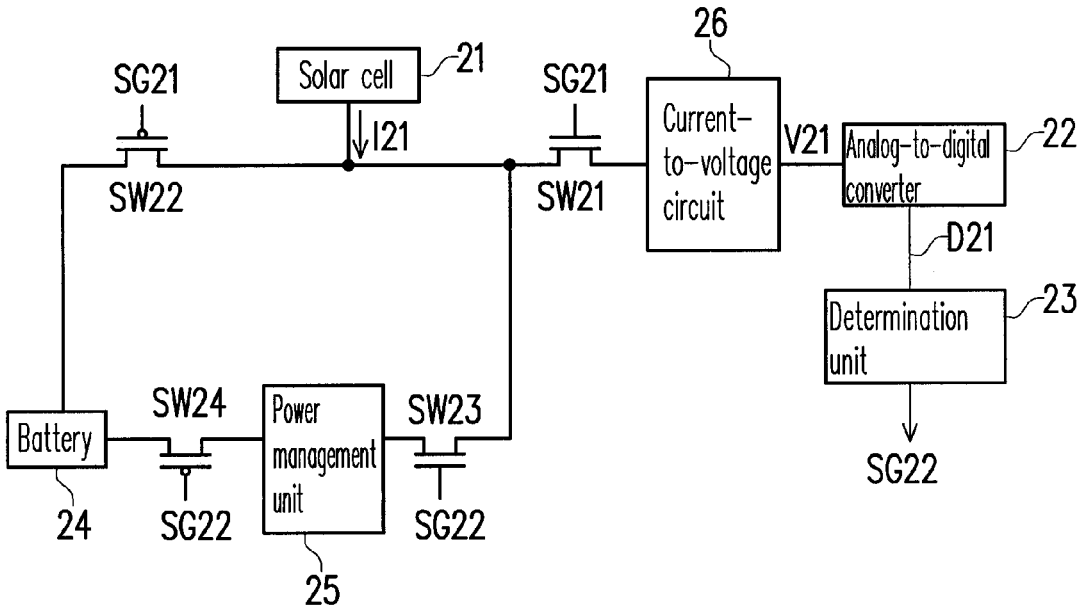
FIG. 12 is a circuit block diagram of the embodiment in FIG. 11.

FIG. 11 is a detailed flowchart of foregoing step S190 according to another embodiment of the present invention, and FIG. 12 is a circuit block diagram of the embodiment in FIG. 11. Including a solar cell 21, a plurality of switches SW21~SW24, an analog-to-digital converter 22, a determination unit 23, a battery 24, a power management unit 25, and a current-to-voltage circuit 26.

In step S1101, a sampling period and a charging period are alternatively switched. Then, in step S1102, a battery is charged by the analog current of the electric signal during the charging period. In step S1103, during the sampling period, the analog current is converted into a supply voltage, and the supply voltage is then converted into a digital signal such that the control signal is switched to a first level or a second level according to the digital signal. Accordingly, when the control signal is switched to the first level, the power of the display panel is supplied by the analog current (step S1104). Contrarily, when the control signal is at the second level, the power of the display panel is supplied by the battery (step S1105).

Moreover, the electric signal converted by the external light contains an analog voltage and an analog current, and the circuit illustrated in FIG. 12 is functioned according to the analog current I21 generated by the solar cell 21.

Herein, both the switch SW21 and the switch SW22 are respectively composed of an N-type transistor and a P-type transistor, and both controlled by the same control signal SG21 such that one of the switch SW21 and the switch SW22 is turned on. When the switch SW21 is turned on, the analog current I21 generated by the solar cell 21 is sent to the current-to-voltage circuit 26 and converted into a supply voltage V21. The analog-to-digital converter 22 converts the supply voltage V21 into a digital signal D21, and the determination unit 23 provides the control signal SG22 at the first level (for example, logic 1) or the second level (for example, logic 0) according to the digital signal D21. When the switch SW22 is turned on, the battery 24 is charged by the analog current I21 generated by the solar cell 21.

In other words, the sampling period and the charging period are defined through the switching of the switch SW21 and the switch SW22. During the sampling period, the analog current I21 is converted into the supply voltage V21 by the current-to-voltage circuit 26 and then converted into the corresponding digital signal D21 by the analog-to-digital converter 22 so that the determination unit 23 can generate the corresponding control signal SG22. Contrarily, during the charging period, the analog current I21 is utilized to charge the battery 24.

On the other hand, the control signal SG22 is used for controlling the switch SW23 and the switch SW24 respectively composed of an N-type transistor and a P-type transistor. Accordingly, when the control signal SG22 is switched to the first level (for example, logic 1), the switch SW23 is turned on, and the switch SW24 is turned off. In this case, the analog current I21 is sent to the power management unit 25 to supply the power of the display panel. Contrarily, when the control signal SG22 is switched to the second level (for example, logic 0), the voltage generated by the battery 24 to sent to the power management unit 25 to supply the power of the display panel.

Figure 13:
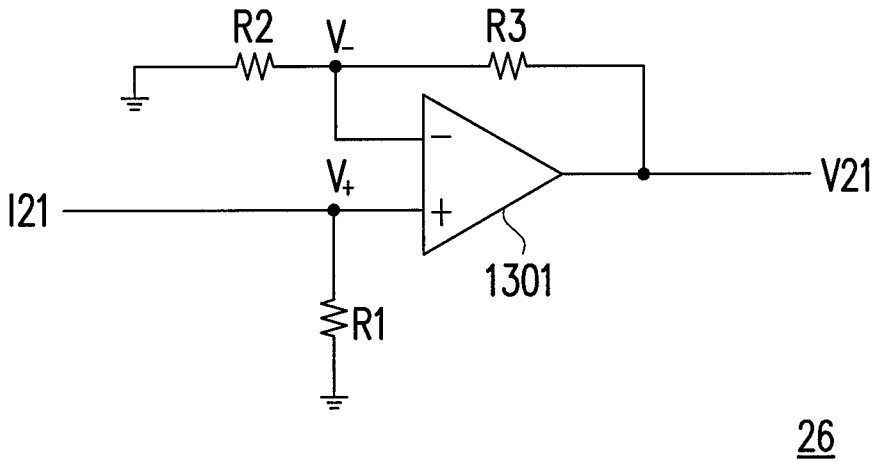
FIG. 13 is a circuit diagram of a current-to-voltage circuit 26 according to an embodiment of the present invention.

It should be mentioned that the conversion ratio between the analog current I21 and the supply voltage V21 can be adjusted through the current-to-voltage circuit 26. FIG. 13 is a circuit diagram of the current-to-voltage circuit 26 according to an embodiment of the present invention wherein the current-to-voltage circuit 26 includes an amplifier 1301 and a plurality of resistors R1~R3.

The resistor R1 is electrically connected between a positive input terminal and a ground terminal of the amplifier 1301, the resistor R2 is electrically connected between a negative input terminal and the ground terminal of the amplifier 1301, and the resistor R3 is electrically connected between the negative input terminal and the output terminal of the amplifier 1301. Accordingly, the feedback mechanism formed by the amplifier 1301 and the resistors R2~R3 results in a relative relationship between the analog current I21 and the supply voltage V21 as:

$$V21 = V_{-} \times \left(1 + \frac{R3}{R2}\right) = V_{+} \times \left(1 + \frac{R3}{R2}\right) = I21 \times R1 \times \left(1 + \frac{R3}{R2}\right) \quad \text{Expression (9)}$$

In foregoing expression (9), $V_{-}$ is the voltage on the negative input terminal of the amplifier 1301, and $V_{+}$ is the voltage on the positive input terminal of the amplifier 1301. According to the relative relationship between the analog current I21 and the supply voltage V21 as shown in the expression (9), the conversion ratio between the analog current I21 and the supply voltage V21 can be adjusted by using the resistors R1~R3 in the current-to-voltage circuit 26.

Second Embodiment

Figure 14:
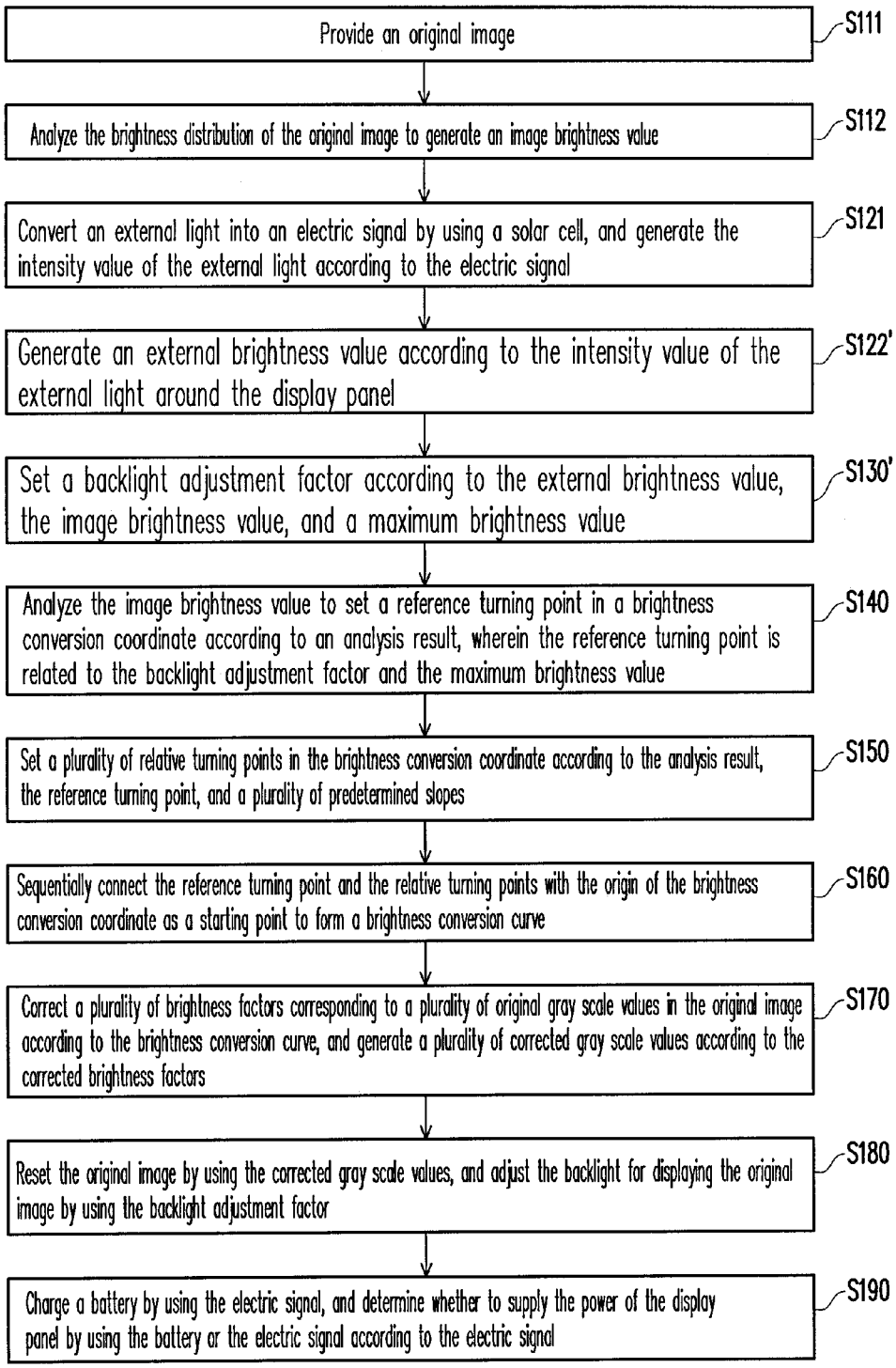
FIG. 14 is a flowchart of an image display method according to a second embodiment of the present invention.

FIG. 14 is a flowchart of an image display method according to the second embodiment of the present invention. The image display method in the present embodiment is adaptable to a transflective display panel. Referring to FIG. 1 and FIG. 14, the difference between the second embodiment and the first embodiment falls on the detailed procedures of the steps S122' and S130'.

To be specific, similar to the first embodiment, an original image is provided in step S111 and analyzed in step S112 to obtain an image brightness value related to the brightness of the original image. Besides, in the present embodiment, in steps S121 and S122', an external brightness value related to the intensity value of an external light is further generated by using an electric signal converted by a solar cell. In step S130', a backlight adjustment factor is set according to the external brightness value, the image brightness value, and a maximum brightness value.

In the present embodiment, a brightness conversion curve in a brightness conversion coordinate is further obtained in steps S140~S160 after the backlight adjustment factor is obtained. Thereafter, in step S170, a plurality of brightness factors in the original image is corrected according to the brightness conversion curve, and a plurality of corresponding corrected gray scale values is generated according to the corrected brightness factors. Thus, in step S180, the backlight of the display panel can be adjusted by using the backlight adjustment factor along with the variations of the external light source, and the original image is reset by using the corrected gray scale values. Similarly, a solar cell is adopted in step S190 of the present embodiment to fully utilize the natural resource.

It should be noted that the light effect induced by the external light irradiating around the display panel varies along with the type of the display panel. In addition, the backlight adjustment performed to the display panel according to the variation of the external light and the external brightness value generated according to the intensity value of the external light also vary along with the type of the display panel. Moreover, the image display method in the present embodiment is adaptable to a transflective display panel, and the image display method in the first embodiment is adaptable to a transmissive display panel. Thus, the major difference between the present embodiment and the first embodiment falls on the method for generating the external brightness value and the corresponding backlight adjustment, namely, the detailed procedures in steps S122' and S130'. Below, the detailed procedures of the steps S122' and S130' will be described, and the other steps in the present embodiment have been described in the first embodiment therefore will not be described herein.

Regarding a transflective display panel, the reflectivity of the display panel increases when the display panel is placed in a bright environment, and in this case, the backlight used by the display panel should be reduced. Contrarily, when the transflective display panel is placed in a dark environment, the display reflects less light and accordingly the backlight thereof should be increased to prevent image distortion. In other words, the backlight adjustment performed to a transflective display panel corresponding to an external light is entirely antithetical to that performed to a transmissive display panel.

Figure 15:
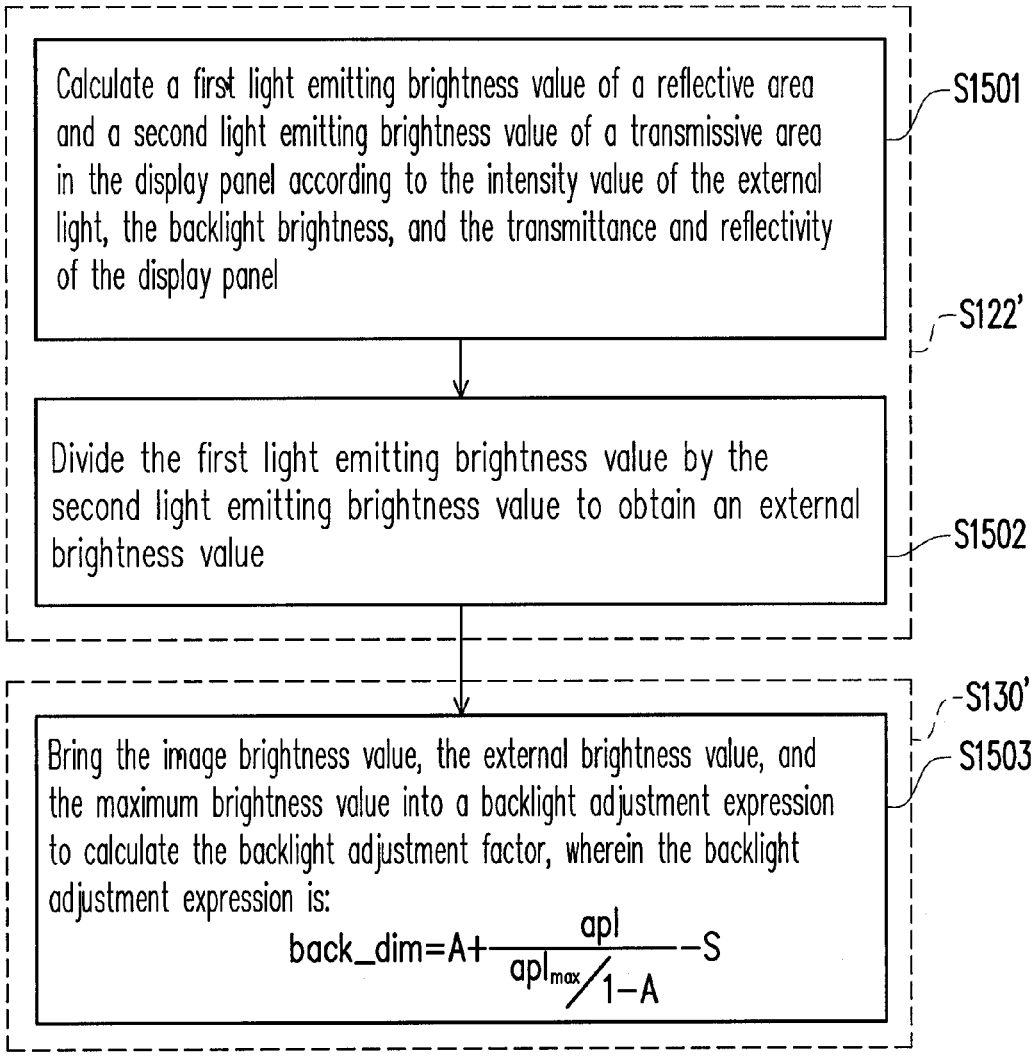
FIG. 15 is a detailed flowchart of steps S122' and S130' in FIG. 14.

FIG. 15 is a detailed flowchart of steps S122' and S130' in FIG. 14. Referring to FIG. 15, to generate the external brightness value, first, in step S1501, a first light emitting brightness value of a reflective area and a second light emitting brightness value of a transmissive area in the display panel are calculated according to the intensity value of the external light detected by a solar cell, the backlight brightness, and the transmittance and reflectivity of the display panel.

For example, if the transmittance N % of the display panel is 5%, the reflectivity M % thereof is 2%, the backlight brightness BLM is 5000 cd/m$^2$, and the intensity value of the external light L is 7000 lux (about 556.8 cd/m$^2$), the first light emitting brightness value tr_light of the reflective area and the second light emitting brightness value tm_light of the transmissive area are respectively:

$$tr_light = L \times M\% = 556.8 \times 2\% = 11.136 \text{ cd/m}^2;$$

$$tm_light = BLM \times N\% = 5000 \times 5\% = 250 \text{ cd/m}^2;$$

wherein cd/m$^2$(candela per square metre) is the unit of luminance, and lux is the unit of illuminance. Through conversion of units, the intensity value of the external light is L=7000 lux=7000/12.75 cd/m$^2$≈556.8 cd/m$^2$.

Next, in step S1502, the first light emitting brightness value is divided by the second light emitting brightness value to obtain an external brightness value. For example, the external brightness value S is calculated according to the first light emitting brightness value and the second light emitting brightness value listed in step S511 as:

$$S = tr_light/tm_light = 11.136/250 \approx 0.0445$$

After the image brightness value apl and the external brightness value S are respectively obtained through steps S112 and S1502, in step S1503, the image brightness value apl, the external brightness value S, and the maximum brightness value $apl_{max}$ are brought into a backlight adjustment expression to calculate the backlight adjustment factor back_dim, wherein the backlight adjustment expression is:

$$\text{back_dim} = A + \frac{apl}{apl_{max}/1 - A} - S \qquad \text{Expression (10)}$$

wherein A is a constant value which falls within a range of 0 to 1.

It should be mentioned that because backlight adjustments performed to a transmissive display panel and a transflective display panel according to the variations of external light are entirely antithetical to each other, the major difference between the backlight adjustment expressions (2) and (10) falls on the relative relationship between the backlight adjustment factor back_dim and the external brightness value S. Regarding to the transmissive display panel, the backlight adjustment factor back_dim is obtained by adding the external brightness value S, while regarding the transflective display panel, the backlight adjustment factor back_dim is obtained by subtracting the external brightness value S.

Third Embodiment

Figure 16:
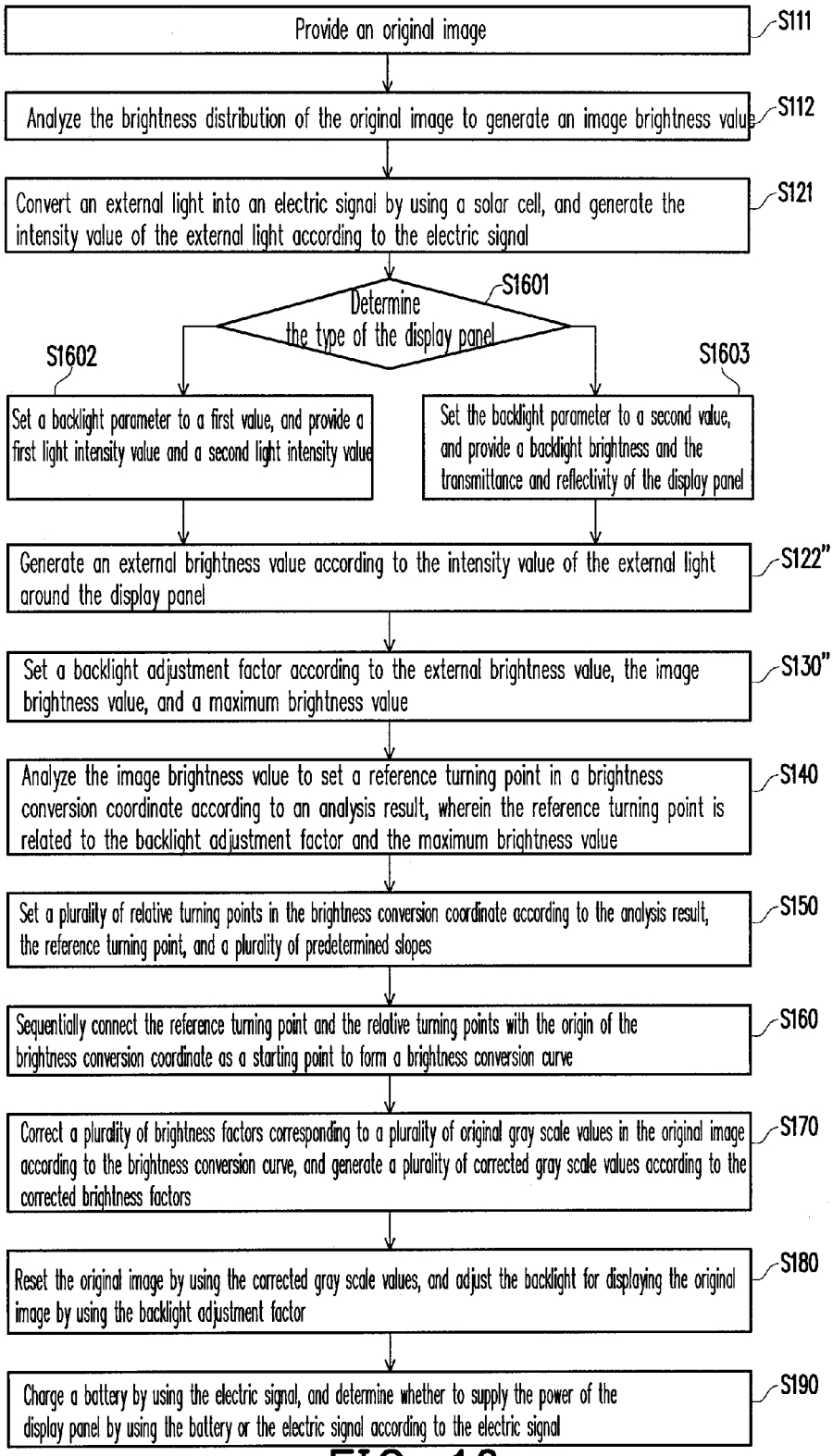
FIG. 16 is a flowchart of an image display method according to a third embodiment of the present invention.

FIG. 16 is a flowchart of an image display method according to the third embodiment of the present invention. The image display method in the present embodiment is adaptable to a transmissive display panel or a transflective display panel. Referring to FIG. 1 and FIG. 16, the difference between the third embodiment and the first embodiment falls on the new steps S1601~S1603 and the detailed procedures of the steps S122" and S130".

To be specific, in the present embodiment, similar to the first embodiment, an original image is provided in step S111 and analyzed in step S112 to obtain an image brightness value related to the brightness of the original image. Besides, in steps S121 and S122", an external brightness value related to the intensity value of an external light is further generated by using an electric signal converted by a solar cell. In step S130", a backlight adjustment factor is set by using the external brightness value, the image brightness value, and a maximum brightness value.

After the backlight adjustment factor is obtained, in the present embodiment, a brightness conversion curve in a brightness conversion coordinate is further obtained through steps S140~S160. In step S170, a plurality of brightness factors in the original image is corrected according to the brightness conversion curve, and a plurality of corrected gray scale values is generated according to the corrected brightness factors. Thus, in the present embodiment, the backlight of the display panel can be adjusted by using the backlight adjustment factor along the variation of the external light, and the original image is reset according to the corrected gray scale values. Similarly, a solar cell is adopted in step S190 of the present embodiment to utilize the natural resource.

Moreover, since the image display method in the present embodiment is adaptable to both a transmissive display panel and a transflective display panel, steps S1601~S1603 are further executed in the present embodiment.

In step S1601, if the display panel is a transmissive display panel, in step S1602, a backlight parameter is set to a first value (for example, +1), and a first light intensity value and a second light intensity value are provided, wherein the first light intensity value is smaller than the second light intensity value. If the display panel is a transflective display panel, in step S1603, the backlight parameter is set to a second value (for example, −1), and a backlight brightness and the transmittance and reflectivity of the display panel are provided.

An external brightness value is then generated through different method according to the determination result of step S1601 and the values provided in steps S1602 and S1603, and the backlight is adjusted accordingly. In other words, the difference between the present embodiment and the first embodiment falls on the method for generating the external brightness value and the corresponding backlight adjustment, namely, the detailed procedures in steps S122" and S130". Below, the detailed procedures of the steps S122" and S130" will be described, and the other steps in the present embodiment have been described in foregoing embodiments therefore will not be described herein.

Figure 17:
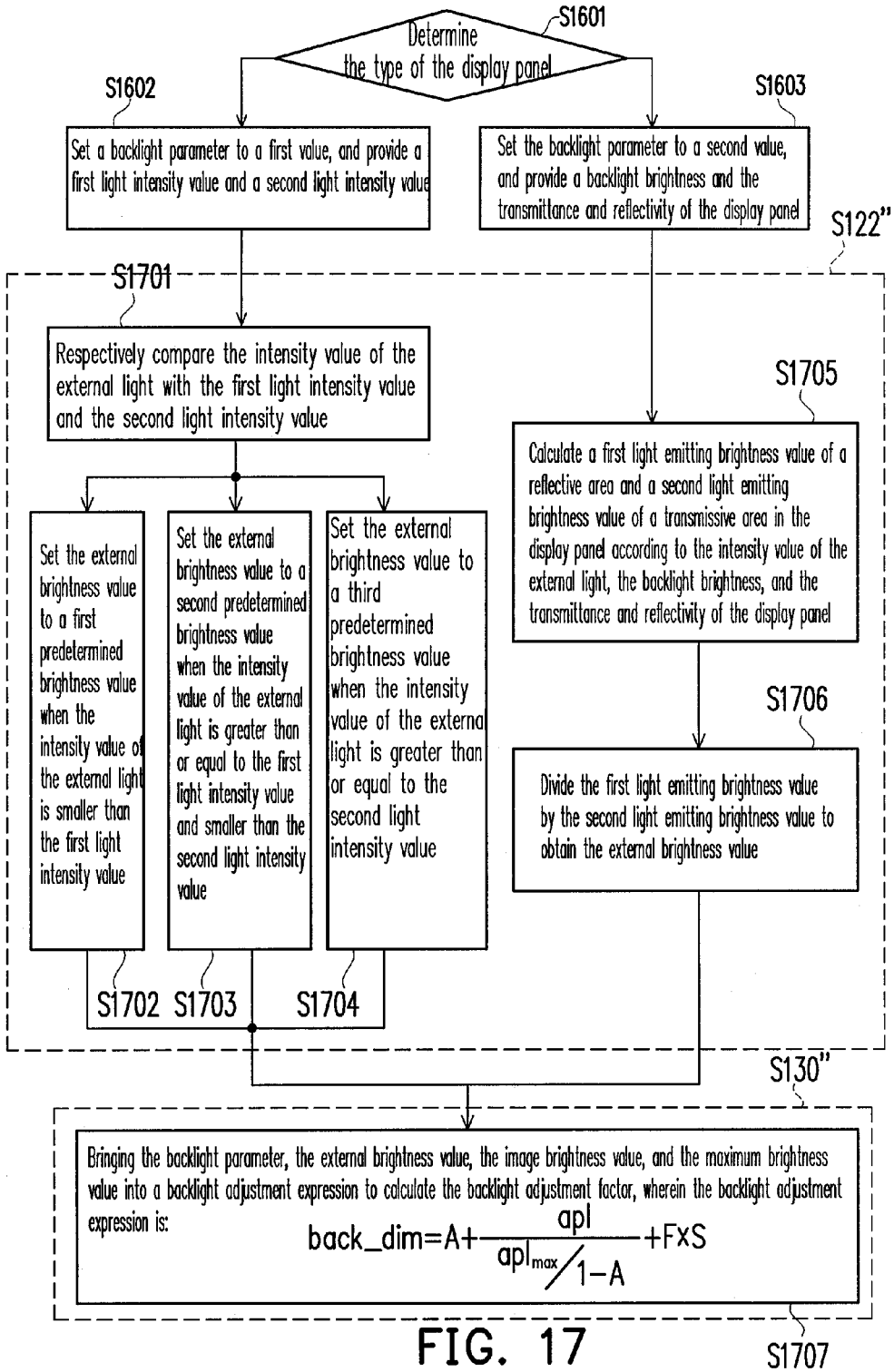
FIG. 17 is a detailed flowchart of steps S122" and S130" in FIG. 16.

FIG. 17 is a detailed flowchart of steps S122" and S130" in FIG. 16, wherein steps S1601~S1603 are further added in FIG. 17. Referring to FIG. 17, the external brightness value is obtained in steps S1701~S1704 according to the values provided in step S1602 if it is determined in step S1601 that the display panel is a transmissive display panel.

In step S1701, the intensity value of the external light detected by a solar cell is respectively compared with the first light and the second light intensity value. If the intensity value of the external light is smaller than the first light intensity value, the external brightness value is set to a first predetermined brightness value in step S1702. If the intensity value of the external light is greater than or equal to the first light intensity value and smaller than the second light intensity value, the external brightness value is set to a second predetermined brightness value in step S1703. If the intensity value of the external light is greater than or equal to the second light intensity value, the external brightness value is set to a third predetermined brightness value in step S1704. The steps S1701~S1704 are the same as or similar to the steps S411~S414 illustrated in FIG. 4 therefore will not be described herein.

On the other hand, the external brightness value is obtained through steps S1705 and S1706 according to the values provided in step S1603 if it is determined in step S1601 that the display panel is a transflective display panel. In step S1705, a first light emitting brightness value of a reflective area and a second light emitting brightness value of a transmissive area in the display panel are calculated according to the intensity value of the external light detected by the solar cell, the backlight brightness, and the transmittance and reflectivity of the display panel. Then, in step S1706, the first light emitting brightness value is divided by the second light emitting brightness value to obtain the external brightness value. The steps S1705~S1706 are the same as or similar to the steps S1501~1502 illustrated in FIG. 15 therefore will not be described herein.

On the other hand, after the image brightness value apl and the external brightness value S are respectively obtained through steps S112 and S122", in step S1707, a backlight parameter F, the image brightness value apl, the external brightness value S, and the maximum brightness value $apl_{max}$ provided in step S1602 or S1603 are brought into a backlight adjustment expression to calculate the backlight adjustment factor back_dim, wherein the backlight adjustment expression is:

$$\text{back_dim} = A + \frac{apl}{apl_{max}/1 - A} + F \times S \qquad \text{Expression (11)}$$

wherein A is a constant value which falls within a range of 0 to 1.

It should be mentioned that because the backlight adjustments performed to a transmissive display panel and a transflective display panel according to the variations of external light are entirely antithetical to each other, the relative relationship between the backlight adjustment factor back_dim and the external brightness value S varies along with the different type of the display panel. Thus, in the present embodiment, the relative relationship between the backlight adjustment factor back_dim and the external brightness value S is adjusted by using the backlight parameter F, wherein F=1 if the display panel is a transmissive display panel and F=−1 if the display panel is a transflective display panel.

Fourth Embodiment

Figure 18:
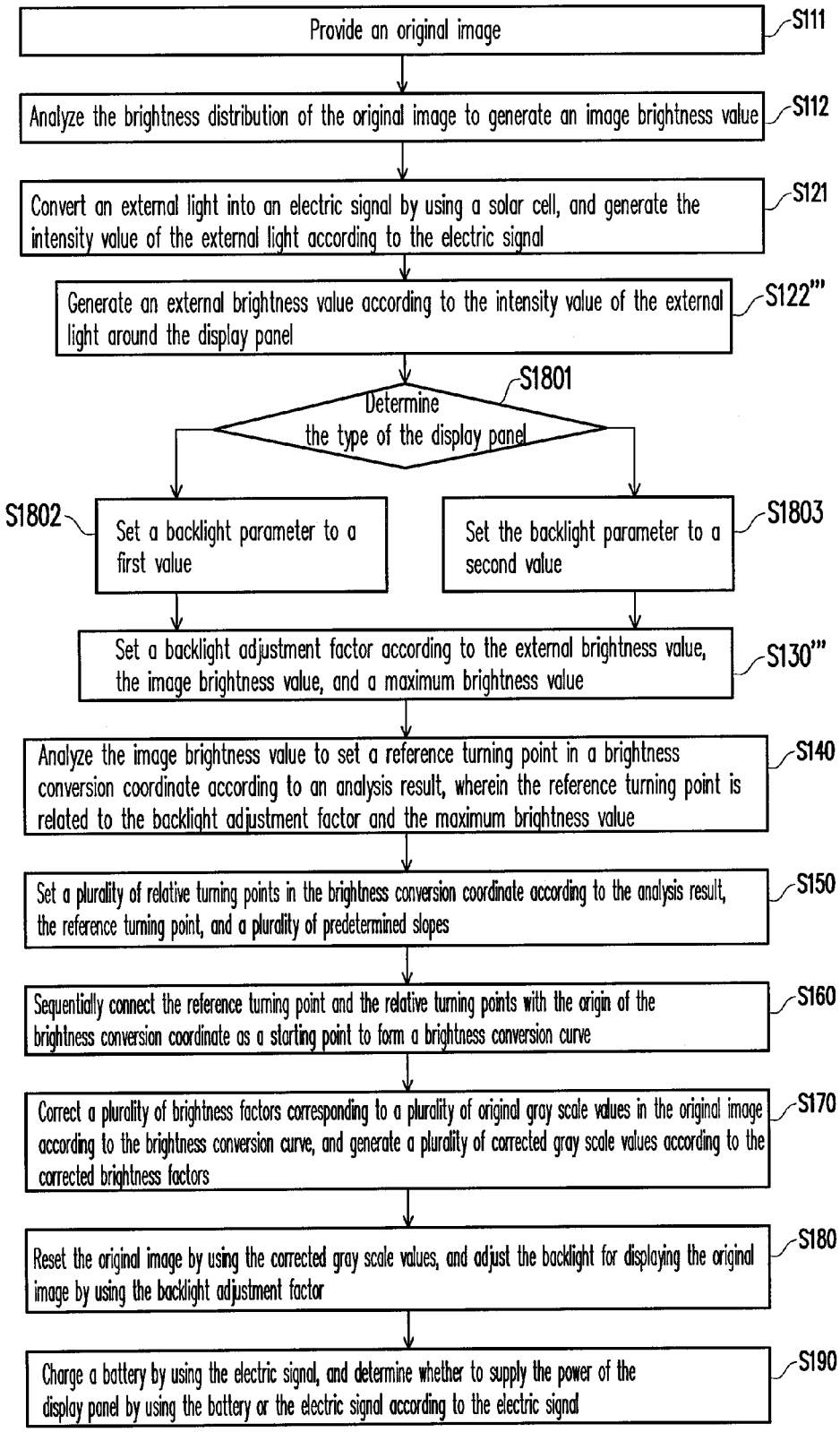
FIG. 18 is a flowchart of an image display method according to a fourth embodiment of the present invention.

FIG. 18 is a flowchart of an image display method according to the fourth embodiment of the present invention. The image display method in the present embodiment is adaptable to a transmissive display panel or a transflective display panel. Referring to FIG. 1 and FIG. 18, the difference between the fourth embodiment and the first embodiment falls on the new steps S1801~S1803 and the detailed procedures of the steps S122'" and S130'".

To be specific, in the present embodiment, similar to the first embodiment, an original image is provided in step S111 and analyzed in step S112 to obtain an image brightness value related to the brightness of the original image. Besides, in steps S121 and S122'", an external brightness value related to the intensity value of an external light is further generated by using an electric signal converted by a solar cell. In step S130'", a backlight adjustment factor is set by using the external brightness value, the image brightness value, and a maximum brightness value.

After the backlight adjustment factor is obtained, in the present embodiment, a brightness conversion curve in a brightness conversion coordinate is further obtained through steps S140~S160. In step S170, a plurality of brightness factors in the original image is corrected according to the brightness conversion curve, and a plurality of corrected gray scale values is generated according to the corrected brightness factors. In step S180, the backlight of the display panel is adjusted by using the backlight adjustment factor along the variation of the external light, and the original image is reset according to the corrected gray scale values. Similarly, a solar cell is adopted in step S190 of the present embodiment to fully utilize the natural resource.

It should be noted that the light effect induced by the external light irradiating around the display panel varies along with the type of the display panel. In addition, the backlight adjustment performed to the display panel according to the variation of the external light and the external brightness value generated according to the intensity value of the external light also vary along with the type of the display panel. Moreover, since the image display method in the present embodiment is adaptable to both a transmissive display panel and a transflective display panel, steps S1801~S1803 are further executed in the present embodiment.

In step S1801, whether the display panel is a transmissive display panel or a transflective display panel is determined. If the display panel is a transmissive display panel, in step S1802, a backlight parameter is set to a first value (for example, +1). If the display panel is a transflective display panel, in step S1803, the backlight parameter is set to a second value (for example, −1).

The backlight is adjusted according to the determination result in step S1801 and the values provided in steps S1802 and S1803. It should be noted that in the present embodiment, the external brightness value is not calculated through different method according to the type of the display panel. Instead, in the present embodiment, the intensity value of the external light is directly converted into the corresponding external brightness value, and the backlight adjustment factor is calculated through a backlight adjustment expression different from those in the first, the second, and the third embodiment.

In other words, another difference between the present embodiment and the first embodiment falls on the method for generating the external brightness value and the backlight adjustment, namely, the detailed procedures in steps S122'" and S130'". Below, the detailed procedures of the steps S122'"

and S130''' will be described, and the other steps in the present embodiment have been described in foregoing embodiments therefore will not be described herein.

Figure 19:
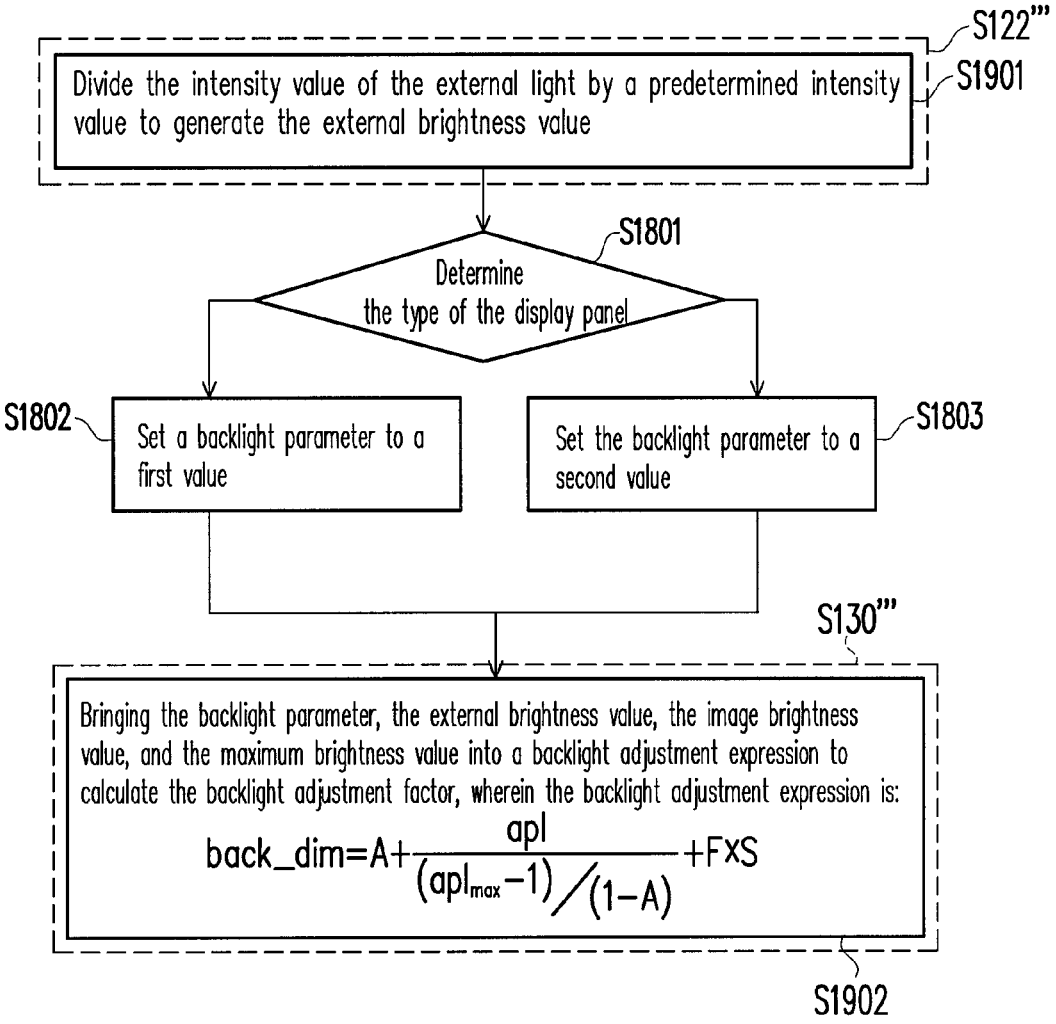
FIG. 19 is a detailed flowchart of steps S122'" and S130'" in FIG. 18.

FIG. 19 is a detailed flowchart of steps S122''' and S130''' in FIG. 18, wherein steps S1801~S1803 are further added in FIG. 19. Referring to FIG. 19, in step S1901, the intensity value of the external light is divided by a predetermined intensity value to generate the external brightness value. For example, the intensity value of the external light may be directly divided by 50000. Herein the higher the intensity value of the external light is, the greater the external brightness value is; contrarily, the lower the intensity value of the external light is, the smaller the external brightness value is.

Thereafter, the type of the display panel is determined in step S1801, and a corresponding backlight parameter is generated through steps S1802 and S1803. Next, in step S1902, the backlight parameter F provided in step S1802 or S1803, the image brightness value apl provided in step S112, the external brightness value S, and the maximum brightness value $apl_{max}$ are brought into a backlight adjustment expression to calculate the backlight adjustment factor back_dim, wherein the backlight adjustment expression is:

$$\text{back_dim} = A + \frac{apl}{(apl_{max} - 1)/(1 - A)} + F \times S \qquad \text{Expression (12)}$$

wherein A is a constant value which falls within a range of 0 to 1.

It should be mentioned that because the backlight adjustments performed to a transmissive display panel and a transflective display panel according to the variations of external light are entirely antithetical to each other, the relative relationship between the backlight adjustment factor back_dim and the external brightness value S varies along with the different type of the display panel. Thus, in the present embodiment, the relative relationship between the backlight adjustment factor back_dim and the external brightness value S is adjusted by using the backlight parameter F, wherein F=1 if the display panel is a transmissive display panel, and F=−1 if the display panel is a transflective display panel.

As described above, in the present invention, a backlight of a display panel is adaptively adjusted by using a backlight adjustment factor related to the intensity value of an external light and the brightness of an original image, so that the external light can be served as an assistant light source and the power consumption of the display panel can be effectively reduced. In addition, in the present invention, brightness factors of the original image are corrected according to the adjustment of the backlight, and the original image is reset by using the corrected brightness factors. Accordingly, in the present invention, the problem of image contrast distortion caused by backlight adjustment can be effectively resolved without affecting the visual effect of the original image and increasing the hardware/software cost. Moreover, in the present invention, a solar cell is adopted and the power required the display panel is supplied by using an external light source, so that the display panel is made more environment-friendly It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An image display method adapted to a display apparatus comprising a display panel and a backlight module, comprising:

analyzing a brightness distribution of an original image to generate an image brightness value;

generating an external brightness value according to an intensity value of an external light around the display panel;

setting a backlight adjustment factor according to the external brightness value, the image brightness value, and a maximum brightness value;

analyzing the image brightness value to set a reference turning point of a brightness conversion coordinate according to an analysis result, wherein the reference turning point is related to the backlight adjustment factor (back_dim) and the maximum brightness value;

setting a plurality of relative turning points of the brightness conversion coordinate according to the analysis result, the reference turning point, and a plurality of predetermined slopes;

sequentially connecting the reference turning point and the relative turning points with an origin of the brightness conversion coordinate as a starting point, so as to form a brightness conversion curve;

correcting a plurality of brightness factors corresponding to a plurality of original gray scale values in the original image according to the brightness conversion curve, and generating a plurality of corresponding corrected gray scale values according to the corrected brightness factors; and resetting the original image by using the connected gray scale values, and adjusting a backlight of the backlight module for displaying the original image by using the backlight adjustment factor.

2. The image display method according to claim 1, wherein the step of analyzing the brightness distribution of the original image to generate the image brightness value comprises:

converting the original gray scale values in the original image into a plurality of brightness analysis values according to a conversion expression, wherein when the $i^{th}$ brightness analysis value is denoted as $BT_i$, three sub gray scale values in the $i^{th}$ original gray scale value are respectively denoted as $r_i$, $g_i$, and $b_1$, the maximum brightness value is denoted as $apl_{max}$, $gr_{max}$ is a maximum gray scale value, and i is an integer greater than 0, the conversion expression is:

$$BT_i = (0.299 \times r_i + 0.578 \times g_i + 0.114 \times b_i) \times \frac{apl_{max}}{gr_{max}};$$

counting numbers of pixels having the same brightness analysis values to establish a histogram with the brightness analysis values as an abscissa and the numbers of pixels as an ordinate; and accumulating the numbers of pixels in the histogram, and capturing the brightness analysis value on the abscissa of the histogram to generate the image brightness value when an accumulated total number reaches a specific percentage of a total pixel number of the original image.

3. The image display method according to claim 2, wherein the specific percentage is 50%.

4. The image display method according to claim 1, wherein the display panel is a transmissive display panel.

5. The image display method according to claim 4, wherein the step of generating the external brightness value according to the intensity value of the external light around the display panel comprises:

respectively comparing the intensity value of the external light with a first light intensity value and a second light intensity value, wherein the first light intensity value is smaller than the second light intensity value;

setting the external brightness value to a first predetermined brightness value when the intensity value of the external light is smaller than the first light intensity value; and setting the external brightness value to a second predetermined brightness value when the intensity value of the external light is greater than or equal to the first light intensity value and smaller than the second light intensity value; and setting the external brightness value to a third predetermined brightness value when the intensity value of the external light is greater than or equal to the second light intensity value.

6. The image display method according to claim 5 further comprising:

adjusting the first light intensity value and the second light intensity value according to a backlight transmissible ratio.

7. The image display method according to claim 6 further comprising:

generating the backlight transmissible ratio according to the backlight adjustment factor.

8. The image display method according to claim 4, wherein the step of setting the backlight adjustment factor according to the external brightness value, the image brightness value, and the maximum brightness value comprises:

bringing the external brightness value (S), the image brightness value (apt), and the maximum brightness value ($apl_{max}$) into a backlight adjustment expression to calculate the backlight adjustment factor, wherein A is a constant value which falls within a range of 0 to 1, and the backlight adjustment expression is:

$$\text{back_dim} = A + \frac{apl}{apl_{max}/1 - A} + S.$$

9. The image display method according to claim 1, wherein the display panel is a transflective display panel.

10. The image display method according to claim 9, wherein the step of generating the external brightness value according to the intensity value of the external light around the display panel comprises:

calculating a first light emitting brightness value of a reflective area and a second light emitting brightness value of a transmissive area in the display panel according to a backlight brightness, the intensity value of the external light, and a transmittance and a reflectivity of the display panel; and dividing the first light emitting brightness value by the second light emitting brightness value to obtain the external brightness value.

11. The image display method according to claim 9, wherein the step of setting the backlight adjustment factor according to the external brightness value, the image brightness value, and the maximum brightness value comprises:

bringing the external brightness value (S), the image brightness value (apl), and the maximum brightness value ($apl_{max}$) into a backlight adjustment expression to calculate the backlight adjustment factor, wherein when A is a constant value which falls within a range of 0 to 1, the backlight adjustment expression is:

$$\text{back_dim} = A + \frac{apl}{apl_{max}/1 - A} - S.$$

12. The image display method according to claim 1, wherein the predetermined slopes comprise a first predetermined value (A), a second predetermined value (B), a third predetermined value (C), and a fourth predetermined value (D), and the steps of analyzing the image brightness value to set the reference turning point in the brightness conversion coordinate according to the analysis result and setting the relative turning points in the brightness conversion coordinate according to the analysis result, the reference turning point, and the predetermined slopes comprises:

determining whether the image brightness value is greater than a predetermined value;

when the image brightness value is greater than the predetermined value, generating a threshold by using the backlight adjustment factor and the maximum brightness value ($apl_{max}$), and setting coordinates of the reference turning point as $(a_0,b_0)$, wherein threshold=back_dim×$apl_{max}$, $a_0$=threshold×back_dim, and $b_0$=threshold;

when the image brightness value is smaller than the predetermined value, generating the threshold by using the back_dim, the maximum brightness value ($apl_{max}$), and a brightness discrimination value (a) related to the image brightness value, and setting coordinates of the reference turning point as $(a_0,b_0)$, wherein threshold=back_dim×$apl_{max}$+a, $a_0$=threshold×back_dim, and $b_0$=threshold;

when the image brightness value is greater than the predetermined value, the relative turning points comprising a first turning point to a third turning point, and setting coordinates of the first turning point as $(a_1,b_1)$, coordinates of the second turning point as $(a_2,b_2)$, and coordinates of the third turning point as $(a_3,b_3)$, wherein $a_1,b_1=apl_{max}$, $a_2=((apl_{max}-a_0)\times B)+a_3$, $b_2=(apl_{max}-(C\times(apl_{max}-a_2)))$, $a_3=((apl_{max}-a_0)\times A)+a_0$, and $b_3=(b_2-(D\times(a_2-a_3)))$; and when the image brightness value is smaller than the predetermined value, the relative turning points comprising the first turning point to the third turning point and a fourth turning point, and setting coordinates of the first turning point as $(a_1,b_1)$, coordinates of the second turning point as $(a_2,b_2)$, coordinates of the third turning point as $(a_3,b_3)$, and coordinates of the fourth turning point as $(a_4,b_4)$, wherein $a_1,b_1=apl_{max}$, $a_2=((apl_{max}=a_0)\times B)+a_3$, $b_2(apl_{max}-(C\times(apl_{max}-a_2)))$, $a_3=((apl_{max}-a_0)\times A)+a_0$, $b_3=(b_2-(D\times(a_2-a_3)))$, $a_4$=a, and $b_4$=0.

13. The image display method according to claim 12, wherein the first predetermined value (A) is 0.28, the second predetermined value (B) is 0.31, the third predetermined value (C) is 0.3, and the fourth predetermined value (D) is 1.3.

14. The image display method according to claim 1, wherein the step of correcting the brightness factors corresponding to the original gray scale values in the original image according to the brightness conversion curve and generating the corresponding corrected gray scale values according to the corrected brightness factors comprises:

converting a color format of the original image to obtain the brightness factors corresponding to the original gray scale values and a plurality of color factors;

converting the brightness factors into a plurality of corrected brightness factors according to the brightness conversion curve; and converting the corrected brightness factors and the color factors into the corresponding corrected gray scale values.

15. The image display method according to claim 1, wherein the step of adjusting the backlight for displaying the original image by using the backlight adjustment factor comprises:

generating a pulse width modulation (PWM) signal according to the backlight adjustment factor; and controlling the backlight for displaying the original image by the PWM signal.

16. The image display method according to claim 1 further comprising:

converting the external light into an electric signal by a solar cell, and generating the intensity value of the external light according to the electric signal; and charging a battery by using the electric signal, and determining the display panel is supplied by the battery or the electric signal according to the electric signal.

17. The image display method according to claim 16, wherein the electric signal comprises an analog voltage, and the step of charging the battery by using the electric signal and determining the display panel is supplied by the battery or the electric signal according to the electric signal comprises:

alternatively switching a sampling period and a charging period;

charging the battery by the analog voltage during the charging period;

converting the analog voltage into a digital signal whereby a control signal is switched to a first level or a second level according to the digital signal during the sampling period;

supplying the display panel by the analog voltage when the control signal is switched to the first level; and supplying the display panel by the battery when the control signal is switched to the second level.

18. The image display method according to claim 16, wherein the electric signal comprises an analog current, and the step of charging the battery by using the electric signal and determining whether the display panel is supplied by the battery or the electric signal according to the electric signal comprises:

alternatively switching a sampling period and a charging period;

charging the battery by the analog current during the charging period;

converting the analog current into a supply voltage, converting the supply voltage into a digital signal, and switching a control signal to a first level or a second level according to the digital signal during the sampling period;

supplying the display panel by the analog current when the control signal is switched to the first level; and supplying the display panel by the battery when the control signal is switched to the second level.

19. The image display method according to claim 1 further comprising:

determining a type of the display panel;

when the display panel is a transmissive display panel, setting a backlight parameter to a first value, and providing a first light intensity value and a second light intensity value, wherein the first light intensity value is smaller than the second light intensity value; and when the display panel is a transflective display panel, setting the backlight parameter to a second value, and providing a backlight brightness and a transmittance and a reflectivity of the display panel.

20. The image display method according to claim 19, wherein the step of generating the external brightness value according to the intensity value of the external light around the display panel comprises:

when the display panel is a transmissive display panel, respectively comparing the intensity value of the external light with the first and the second light intensity values, wherein the external brightness value is set to a first predetermined brightness value when the intensity value of the external light is smaller than the first light intensity value, the external brightness value is set to a second predetermined brightness value when the intensity value of the external light is greater than or equal to the first light intensity value and smaller than the second light intensity value, and the external brightness value is set to a third predetermined brightness value when the intensity value of the external light is greater than or equal to the second light intensity value and when the display panel is a transflective display panel, calculating a first light emitting brightness value of a reflective area and a second light emitting brightness value of a transmissive area in the display panel according to the backlight brightness, the intensity value of the external light, and the transmittance and the reflectivity of the display panel, and dividing the first light emitting brightness value by the second light emitting brightness value to obtain the external brightness value.

21. The image display method according to claim 20 further comprising:

adjusting the first light and the second light intensity values by using a backlight transmissible ratio when the display panel is a transmissive display panel.

22. The image display method according to claim 21 further comprising:

generating the backlight transmissible ratio according to the backlight adjustment factor when the display panel is a transmissive display panel.

23. The image display method according to claim 19, wherein the step of setting the backlight adjustment factor according to the external brightness value, the image brightness value, and the maximum brightness value comprises:

bringing the backlight parameter (F), the external brightness value (S), the image brightness value (apl), and the maximum brightness value ($apl_{max}$) into a backlight adjustment expression to calculate the backlight adjustment factor, wherein F=1 when the display panel is a transmissive display panel, and F=−1 when the display panel is a transflective display panel, A is a constant value which falls within a range of 0 to 1, and the backlight adjustment expression is:

$$\text{back_dim} = A + \frac{apl}{apl_{max}/1 - A} + F \times S.$$

24. The image display method according to claim 1 further comprising:

determining a type of the display panel and setting a backlight parameter to a first value when the display panel is a transmissive display panel; and setting the backlight parameter to a second value when the display panel is a transflective display panel, wherein the step of generating the external brightness value according to the intensity value of the external light around the display panel comprises dividing the intensity value of the external light by a predetermined intensity value to generate the external brightness value.

25. The image display method according to claim 24, wherein the step of setting the backlight adjustment factor according to the external brightness value, the image brightness value, and the maximum brightness value comprises:

bringing the backlight parameter (F), the external brightness value (S), the image brightness value (apl), and the maximum brightness value ($apl_{max}$) into a backlight adjustment expression to calculate the backlight adjustment factor, wherein F=1 when the display panel is a transmissive display panel, and F=−1 when the display panel is a transflective display panel, A is a constant value which falls within a range of 0 to 1, and the backlight adjustment expression is:

$$\text{back_dim} = A + \frac{apl}{(apl_{max} - 1)/(1 - A)} + F \times S.$$

* * * * *